US012181163B2

(12) United States Patent
Zhang et al.

(10) Patent No.: US 12,181,163 B2
(45) Date of Patent: Dec. 31, 2024

(54) AIR CONDITIONER

(71) Applicant: QINGDAO HISENSE HITACHI AIR-CONDITIONING SYSTEMS CO., LTD., Qingdao (CN)

(72) Inventors: Heng Zhang, Qingdao (CN); Yongkun Gao, Qingdao (CN); Jianjun Meng, Qingdao (CN); Xingxiang Xia, Qingdao (CN); Lihua Shi, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 259 days.

(21) Appl. No.: 18/063,204

(22) Filed: Dec. 8, 2022

(65) Prior Publication Data

US 2023/0107874 A1 Apr. 6, 2023

Related U.S. Application Data

(63) Continuation of application No. PCT/CN2021/098800, filed on Jun. 8, 2021.

(30) Foreign Application Priority Data

Jun. 10, 2020 (CN) ..... 202010523966.9
Jun. 10, 2020 (CN) ..... 202010524573.X

(51) Int. Cl.
*F24F 1/32* (2011.01)
*F24F 1/38* (2011.01)
*F25B 13/00* (2006.01)

(52) U.S. Cl.
CPC ..... *F24F 1/32* (2013.01); *F24F 1/38* (2013.01); *F25B 13/00* (2013.01); *F25B 2313/0253* (2013.01); *F25B 2600/02* (2013.01)

(58) Field of Classification Search
CPC ..... F24F 1/32; F24F 1/38; F24F 11/42; F24F 6/02; F25B 13/00; F25B 2313/0253; F25B 2600/01
See application file for complete search history.

(56) References Cited

U.S. PATENT DOCUMENTS

2012/0125033 A1 5/2012 Tanno et al.
2012/0266616 A1* 10/2012 Lee ..... F25B 47/02 62/275

(Continued)

FOREIGN PATENT DOCUMENTS

CN 101469926 A 7/2009
CN 101592430 A 12/2009

(Continued)

OTHER PUBLICATIONS

International Search Report and Written Opinion dated Sep. 9, 2021 in corresponding International Application No. PCT/CN2021/098800, translated, 17 pages.

(Continued)

*Primary Examiner* — Marc E Norman
(74) *Attorney, Agent, or Firm* — MH2 TECHNOLOGY LAW GROUP LLP

(57) ABSTRACT

An air conditioner includes an indoor unit, an outdoor unit, and a controller. The outdoor unit is connected to the indoor unit, and the outdoor unit includes a housing, a compressor, a four-way valve, an outdoor fan, a separating device, and a plurality of outdoor heat exchangers arranged in parallel. The controller is coupled to the compressor, the four-way valve, the outdoor fan, and the driving assembly, and is configured to control a first portion of a refrigerant flowing out from the compressor to flow into an outdoor heat exchanger; control a second portion of the refrigerant flowing out from the compressor to flow into the indoor unit; and when a time in which the first portion of the refrigerant flows (Continued)

into the outdoor heat exchanger is less than a first preset time, prevent a refrigerant flowing out from the indoor unit from flowing into the outdoor heat exchanger, and control the driving assembly to drive the wind blocking portion to move, so as to separate the outdoor fan from the outdoor heat exchanger.

20 Claims, 9 Drawing Sheets

(56) References Cited

U.S. PATENT DOCUMENTS

| | | | | |
|---|---|---|---|---|
| 2019/0154321 | A1 | 5/2019 | Takenaka et al. | |
| 2022/0205675 | A1* | 6/2022 | Miura | F24F 11/89 |

FOREIGN PATENT DOCUMENTS

| | | | |
|---|---|---|---|
| CN | 202973694 | U | 6/2013 |
| CN | 104764112 | A | 7/2015 |
| CN | 104930618 | A | 9/2015 |
| CN | 106568134 | A | 4/2017 |
| CN | 106642403 | A | 5/2017 |
| CN | 107328074 | A | 11/2017 |
| CN | 206755411 | U | 12/2017 |
| CN | 107655070 | A | 2/2018 |
| CN | 107709900 | A | 2/2018 |
| CN | 207113062 | U | 3/2018 |
| CN | 107883454 | A | 4/2018 |
| CN | 107975990 | A | 5/2018 |
| CN | 108302651 | A | 7/2018 |
| CN | 108592194 | A | 9/2018 |
| CN | 108758821 | A | 11/2018 |
| CN | 109086410 | A | 12/2018 |
| CN | 209191647 | U | 8/2019 |
| CN | 111664549 | A | 9/2020 |
| EP | 2378215 | A1 | 10/2011 |
| EP | 2525160 | A1 | 11/2012 |
| EP | 3273188 | A1 | 1/2018 |
| JP | H1089753 | A | 4/1998 |
| JP | H11132603 | A | 5/1999 |
| JP | 2011144996 | A | 7/2011 |
| JP | 2016041988 | A | 3/2016 |

OTHER PUBLICATIONS

Chinese First Office Action dated Nov. 10, 2022 in corresponding Chinese Application No. 202010523966.9, translated, 26 pages.
Chinese First Office Action dated May 20, 2022 in corresponding Chinese Application No. 202010524573.X, translated, 22 pages.
Chinese Second Office Action dated Oct. 12, 2022 in corresponding Chinese Application No. 202010524573.X, translated, 8 pages.
Chinese Third Office Action dated Jan. 18, 2023 in corresponding Chinese Application No. 202010524573.X, translated, 20 pages.
Chinese Decision of Rejection mailed Apr. 28, 2023 in corresponding Chinese Application No. 202010524573.X, translated, 17 pages.
Chinese Second Office Action mailed May 17, 2023 in corresponding Chinese Application No. 202010523966.9, translated, 24 pages.
Chinese Notification of Grant of Patent Rights mailed Aug. 11, 2023 in corresponding Chinese Application No. 202010523966.9, translated, 7 pages.

* cited by examiner

AIR CONDITIONER

CROSS-REFERENCE TO RELATED APPLICATIONS

This application is a continuation of International Patent Application No. PCT/CN2021/098800, filed on Jun. 8, 2021, which claims priority to Chinese Patent Application No. 202010523966.9, filed on Jun. 10, 2020, and Chinese Patent Application No. 202010524573.X, filed on Jun. 10, 2020, which are incorporated herein by reference in their entireties.

TECHNICAL FIELD

The present disclosure relates to the field of air conditioning technologies, and in particular, to an air conditioner.

BACKGROUND

With an advancement of science and technology and an improvement of people's living standards, air conditioners have gradually entered people's lives and become an indispensable product in people's work and life.

A split-type air conditioner includes an air conditioner indoor unit and an air conditioner outdoor unit. The air conditioner indoor unit and the air conditioner outdoor unit are respectively installed indoor and outdoor, and are connected through pipelines and electric wires.

SUMMARY

Some embodiments of the present disclosure provide an air conditioner. The air conditioner includes an indoor unit, an outdoor unit, and a controller. The outdoor unit is connected to the indoor unit, and includes a housing, a compressor, a four-way valve, an outdoor fan, a separating device, and a plurality of outdoor heat exchangers arranged in parallel. The compressor is disposed in the housing. The four-way valve is connected to the compressor and configured to switch flowing directions of a refrigerant. The plurality of outdoor heat exchangers are connected to the compressor and the four-way valve. The outdoor fan is disposed on a side of the plurality of outdoor heat exchangers, and is configured to suck outdoor air into the housing and sends the outdoor air, which has undergone heat exchange through in the plurality of outdoor heat exchangers, out of the housing. The separating device is disposed between two adjacent outdoor heat exchangers of the plurality of outdoor heat exchangers, and includes a wind blocking portion and a driving assembly. The driving assembly is connected to the wind blocking portion, and is configured to drive the wind blocking portion to move, so as to separate a single outdoor heat exchanger in the plurality of indoor heat exchangers from the outdoor fan. The controller is coupled to the compressor, the four-way valve, the outdoor fan, and the driving assembly, and is configured to control a first portion of a refrigerant flowing out from the compressor to flow into the outdoor heat exchanger; control a second portion of the refrigerant flowing out from the compressor to flow into the indoor unit; and when a time in which the first portion of the refrigerant flows into the outdoor heat exchanger is less than a first preset time, the controller is configured to prevent a refrigerant flowing out from the indoor unit from flowing into the outdoor heat exchanger, and control the driving assembly to drive the wind blocking portion to move, so as to separate the outdoor fan from the outdoor heat exchanger.

DETAILED DESCRIPTION

Figure 1:
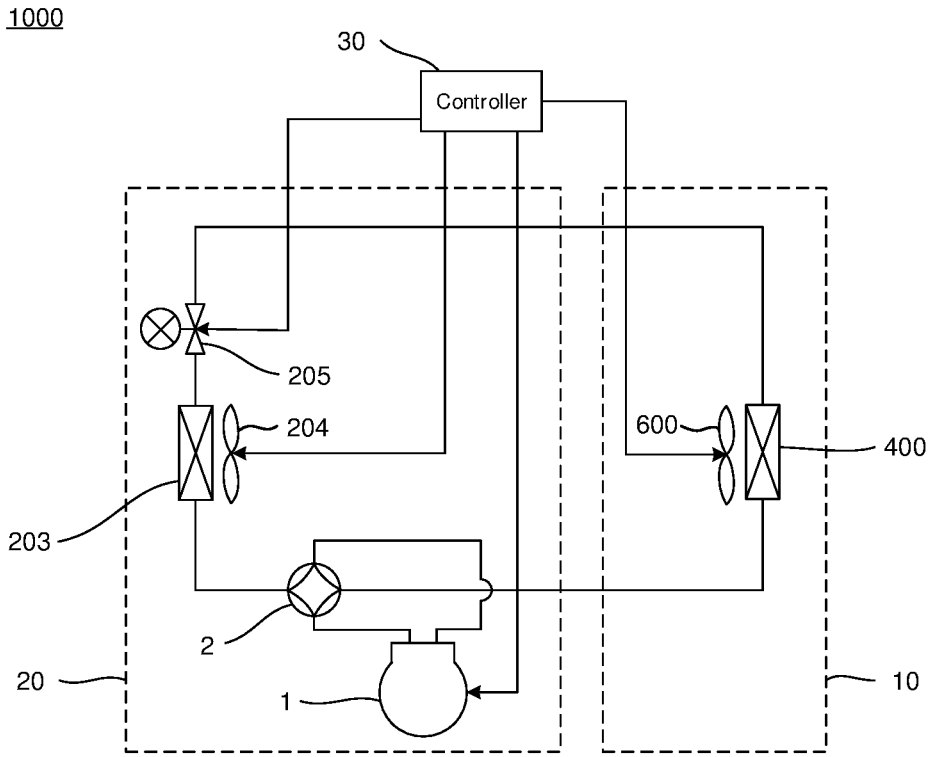
FIG. 1 is a diagram showing a structure of an air conditioner, in accordance with some embodiments.

Technical solutions in some embodiments of the present disclosure will be described clearly and completely below with reference to the accompanying drawings. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description, the term such as "one embodiment," "some embodiments," "exemplary embodiments," "example," "specific example," or "some examples" is intended to indicate that specific features, structures, materials, or characteristics related to the embodiment(s) or example(s) are included in at least one embodiment or example of the present disclosure. Schematic representation of the above term does not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, a features defined with "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled" and "connected" and derivatives thereof may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact with each other. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B, and C" has the same meaning as the phrase "at least one of A, B, or C," both including following combinations of A, B, and C: only A, only B, only C, a combination of A and B, a combination of A and C, a combination of B and C, and a combination of A, B, and C.

The phrase "A and/or B" includes following three combinations: only A, only B, and a combination of A and B.

As used herein, depending on the context, the term "if" is optionally construed as "when," "in a case where," "in response to determining," or "in response to detecting". Similarly, the phrase "if it is determined" or "if [a stated condition or event] is detected" is optionally construed to mean "when it is determined" or "in response to determining" or "when [the stated condition or event] is detected" or "in response to detecting [the stated condition or event]," depending on the context.

The use of "applicable to" or "configured to" herein means an open and inclusive expression, which does not exclude devices that are applicable to or configured to perform additional tasks or steps.

The term "about," "substantially," and "approximately" as used herein includes a stated value and an average value within an acceptable range of deviation of a portionicular value determined by a person of ordinary skill in the art, considering measurement in question and errors associated with measurement of a portionicular quantity (i.e., limitations of a measurement system).

As used herein, "parallel," "perpendicular," and "equal" include the stated conditions and the conditions similar to the stated conditions, and the range of the similar conditions is within the acceptable deviation range, where the acceptable deviation range is determined by a person of ordinary skill in the art in consideration of the measurement in question and the error associated with the measurement of a specific quantity (i.e., the limitation of the measurement system). For example, the term "parallel" includes absolute parallelism and approximate parallelism, and an acceptable range of deviation of the approximate parallelism may be, for example, a deviation within 5°; the term "perpendicular" includes absolute perpendicularity and approximate perpendicularity, and an acceptable range of deviation of the approximate perpendicularity may also be, for example, a deviation within 5°. The term "equal" includes absolute equality and approximate equality, and an acceptable range of deviation of the approximate equality may be, for example, a difference between two equals of less than or equal to 5% of either of the two equals.

Some embodiments of the present disclosure provide an air conditioner.

As shown in FIG. 1, the air conditioner 1000 includes an indoor unit 10 and an outdoor unit 20. The indoor unit 10 and the outdoor unit 20 are connected by pipelines, so as to transmit a refrigerant. The indoor unit 10 includes an indoor heat exchanger 400 and an indoor fan 600. The outdoor unit 20 includes a compressor 1, a four-way valve 2, an outdoor heat exchanger 203, an outdoor fan 204 and an expansion valve 205. The compressor 1, the outdoor heat exchanger 203, the expansion valve 205, and the indoor heat exchanger 400, which are connected sequentially, form a refrigerant loop. The refrigerant circulates in the refrigerant loop, and exchanges heat with air through the outdoor heat exchanger 203 and the indoor heat exchanger 400, so that the air conditioner 1000 operates in a cooling mode or a heating mode.

The compressor 1 is configured to compress the refrigerant, so that a low-pressure refrigerant is compressed to be a high-pressure refrigerant.

The outdoor heat exchanger 203 is configured to exchange heat between outdoor air and a refrigerant flowing in the outdoor heat exchanger 203. For example, the outdoor heat exchanger 203 operates as a condenser in the cooling mode, so that the refrigerant compressed by the compressor 1 is condensed by dissipating heat into the outdoor air through the outdoor heat exchanger 203. The outdoor heat exchanger 203 operates as an evaporator in the heating mode, so that the decompressed refrigerant is evaporated by absorbing heat from the outdoor air through the outdoor heat exchanger 203.

In some embodiments, the outdoor heat exchanger 203 further includes heat exchange fins. In this way, it may be possible to expand a contact area between the outdoor air and the refrigerant flowing in the outdoor heat exchanger 203, and in turn improve heat exchange efficiency between the outdoor air and the refrigerant.

The outdoor fan 204 is configured to suck the outdoor air into the outdoor unit 20 through an outdoor air inlet of the outdoor unit 20, and send the outdoor air, which has exchanged heat with the refrigerant flowing in the outdoor heat exchanger 203, out through an outdoor air outlet of the outdoor unit 20. The outdoor fan 204 provides power for the flow of the outdoor air.

The expansion valve 205 is connected between the outdoor heat exchanger 203 and the indoor heat exchanger 400. A pressure of a refrigerant flowing between the outdoor heat exchanger 203 and the indoor heat exchanger 400 is adjusted by adjusting a magnitude of an opening degree of the expansion valve 205, so that flow rate of the refrigerant flowing between the outdoor heat exchanger 203 and the indoor heat exchanger 400 is adjusted. The flow rate and pressure of the refrigerant flowing between the outdoor heat exchanger 203 and the indoor heat exchanger 400 have an influence on the heat exchange performance of the outdoor heat exchanger 203 and the indoor heat exchanger 400. The expansion valve 205 may be an electronic valve. The opening degree of the expansion valve 205 is adjustable, so as to control the flow rate and pressure of a refrigerant flowing through the expansion valve 205.

The four-way valve 2 is connected in the refrigerant loop. The four-way valve 2 is configured to switch flowing directions of the refrigerant in the refrigerant loop, so that the air conditioner 1000 operates in the cooling mode or the heating mode.

The indoor heat exchanger 400 is configured to exchange heat between the indoor air and a refrigerant flowing in the indoor heat exchanger 400. For example, the indoor heat exchanger 400 operates as an evaporator in the cooling mode, so that the refrigerant, which has been dissipated heat by the outdoor heat exchanger 203, is evaporated by absorbing heat from the indoor air through the indoor heat exchanger 400. The indoor heat exchanger 400 operates as a condenser in the heating mode, so that the refrigerant, which has absorbed heat through the outdoor heat exchanger 203, is condensed by dissipating heat into the indoor air through the indoor heat exchanger 400.

In some embodiments, the indoor heat exchanger 400 further includes heat exchange fins. In this way, it may be possible to expand a contact area between the indoor air and the refrigerant flowing in the indoor heat exchanger 400, and in turn improve heat exchange efficiency between the indoor air and the refrigerant.

The indoor fan 600 is configured to suck the indoor air into the indoor unit 10 through an indoor air inlet of the indoor unit 10, and send the indoor air, which has exchanged heat with the refrigerant flowing in the indoor heat exchanger 400, out through an indoor air outlet of the indoor unit 10. The indoor fan 600 provides power for the flow of the indoor air.

Figure 2:
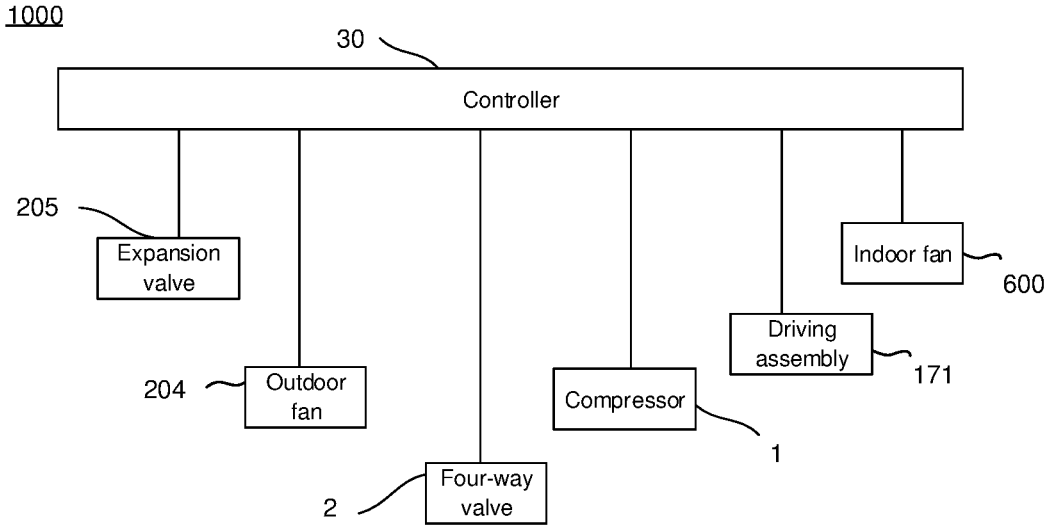
FIG. 2 is a diagram showing a structure of another air conditioner, in accordance with some embodiments.

The air conditioner 1000 further includes a controller 30. The controller 30 is configured to control an operation frequency of the compressor 1, the opening degree of the expansion valve 205, a rotation speed of the outdoor fan 204, and a rotation speed of the indoor fan 600. As shown in FIG. 2, the controller 30 is coupled to the compressor 1, the expansion valve 205, four-way valve 2, the outdoor fan 204, and the indoor fan 600 through data lines, so as to transmit communication information.

The controller 30 includes a processor, such as a central processing unit (CPU), a microprocessor, or an application specific integrated circuit (ASIC).

In a case where the air conditioner operates in the heating mode, and the outdoor temperature is low and the outdoor humidity is high, frost is formed on the outdoor heat exchanger of the air conditioner. As the frosting amount increases, a surface of the outdoor heat exchanger is covered by frost. As a result, a surface heat transfer coefficient of the outdoor heat exchanger is reduced, and an air flow resistance is increased, which seriously affects the heating effect of the air conditioner. Therefore, the air conditioner needs to be defrosted regularly.

In the air conditioner, the four-way valve switches the flowing directions of the refrigerant, and the outdoor heat exchanger operates as a condenser; the outdoor heat exchanger is defrosted based on the sensible heat and the latent heat of condensation of the high-temperature and high-pressure refrigerant, and the air conditioner has a high defrosting speed and a high reliability. However, the heating operation of the air conditioner is stopped during defrosting; in addition, the indoor heat exchanger operates as an evaporator and absorbs heat from the indoor room, so that the indoor temperature is greatly reduced, and indoor thermal comfort is declined.

Alternatively, the air conditioner is provided therein with a hot gas bypass to defrost the outdoor heat exchanger. That is, in a case where the flowing direction of the refrigerant in the air conditioner is unchanged during defrosting, the exhausted gas from the compressor is transmitted into a to-be-defrosted outdoor heat exchanger through the hot gas bypass, so as to defrost the to-be-defrosted outdoor heat exchanger. In this way, this defrosting manner, regarded as a low-pressure defrosting manner, is performed by using the heat converted by part of power consumption of the compressor, resulting in less heat and long defrosting time. During defrosting through the hot gas bypass, the hot gas with low pressure and sensible heat is utilized for defrosting, the temperature of the hot gas is low, a heat exchange temperature difference between the hot gas and a frost layer is small, and a defrosting reliability is poor; although the flowing direction of the refrigerant is not changed during defrosting, the flow rate of the refrigerant in the indoor unit is small, the air conditioner does not provide heat for the indoor unit, the indoor temperature is reduced during defrosting, and the comfort of users is poor.

Figure 3:
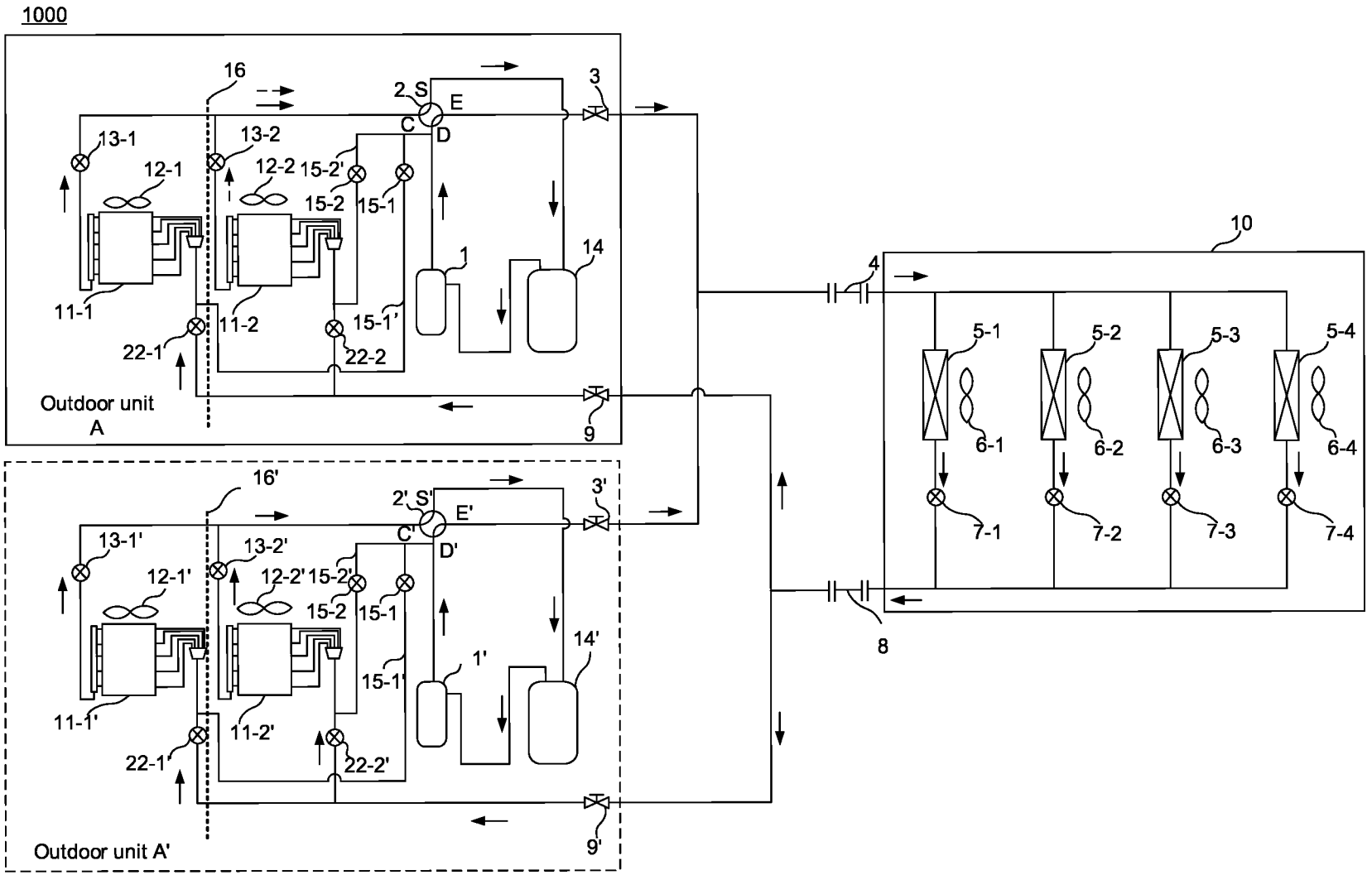
FIG. 3 is a diagram showing a structure of yet another air conditioner, in accordance with some embodiments.

In light of this, in some embodiments, referring to FIG. 3, the air conditioner 1000 is a multi-split air conditioner. That is, the air conditioner 1000 includes at least one indoor unit 10.

The indoor unit 10 includes a plurality of indoor heat exchangers and a plurality of indoor fans. For example, the indoor unit 10 includes four indoor heat exchangers and four indoor fans. The four indoor heat exchangers are indoor heat exchangers 5-1 to 5-4, the four indoor fans are indoor fans 6-1 to 6-4, and each of the indoor fans 6-1 to 6-4 is configured to blow an indoor air that has changed heat with a refrigerant flowing in a respective one of the indoor heat exchangers 5-1 to 5-4 to the indoor room.

The air conditioner 1000 includes a plurality of outdoor units 20. For example, as shown in FIG. 3, the air conditioner 1000 includes two outdoor units A and A', and the outdoor units A and A' are arranged in parallel. The outdoor units A and A' may have a same structure, or different structures.

The structure of the outdoor unit A is described below by taking an example in which the outdoor units A and A' may have the same structure.

The outdoor unit A includes a compressor 1, a four-way valve 2, outdoor heat exchangers 11-1 and 11-2 (or referred to as a first outdoor heat exchanger 11-1 and a second outdoor heat exchanger 11-2), outdoor fans 12-1 and 12-2, a first separating device 16, first throttling devices 22-1 and 22-2, and second throttling devices 13-1 and 13-2. In the same outdoor unit, the number of the outdoor heat exchangers may be the same as the number of the outdoor fans, and the plurality of outdoor heat exchangers may correspond to the plurality of outdoor fans; alternatively, the number of the outdoor heat exchangers may be greater than the number of the outdoor fans, and at least part of the outdoor heat exchangers may share a same outdoor fan. For example, two outdoor heat exchangers included in a same outdoor unit share a same outdoor fan.

For example, as shown in FIG. 3, in the outdoor unit A, the number of outdoor heat exchangers is the same as the number of outdoor fans, and the plurality of outdoor heat exchangers correspond to the plurality of outdoor fans one by one.

The compressor 1, the four-way valve 2, the outdoor fans 12-1 and 12-2, the first separating device 16, the first throttling devices 22-1 and 22-2, and the second throttling devices 13-1 and 13-2 are each controlled by the controller 30.

The first throttling devices 22-1 and 22-2 are connected to liquid pipes of the indoor heat exchangers 5-1 to 5-4 and a liquid pipe of the outdoor heat exchanger 11-1. The second throttling device 13-1 is connected to an air pipe of the outdoor heat exchanger 11-1, and the second throttling device 13-2 is connected to an air pipe of the outdoor heat exchanger 11-2.

For example, as shown in FIG. 3, the four-way valve 2 includes four terminals C, D, S, and E. In a case where the four-way valve 2 is powered off, the terminals C and D are connected by default, and the terminals S and E are connected by default, so that the indoor heat exchangers 5-1 to 5-4 operate as evaporators, and the air conditioner 1000 operates in the cooling mode. In a case where the four-way valve 2 is powered on to switch the flowing directions of the refrigerant, the terminals C and S are connected, and the terminals D and E are connected, so that the indoor heat exchangers 5-1 to 5-4 operate as condensers, and the air conditioner 1000 operates in the heating mode.

The outdoor fan 12-1 corresponds to the outdoor heat exchanger 11-1, and the outdoor fan 12-1 and the outdoor heat exchanger 11-1 develop a first wind field. The outdoor fan 12-2 corresponds to the outdoor heat exchanger 11-2, and the outdoor fan 12-2 and the outdoor heat exchanger 11-2 develop a second wind field.

The first separating device 16 is configured to separate adjacent wind fields from each other, so that each wind field is independent and not affected by wind fields adjacent thereto. Therefore, when the outdoor fan 12-1 operates, the outdoor fan 12-1 does not blow wind toward the outdoor heat exchanger 11-2; and when the outdoor fan 12-2 operates, the outdoor fan 12-2 does not blow wind toward the outdoor heat exchanger 11-1.

Figure 6:
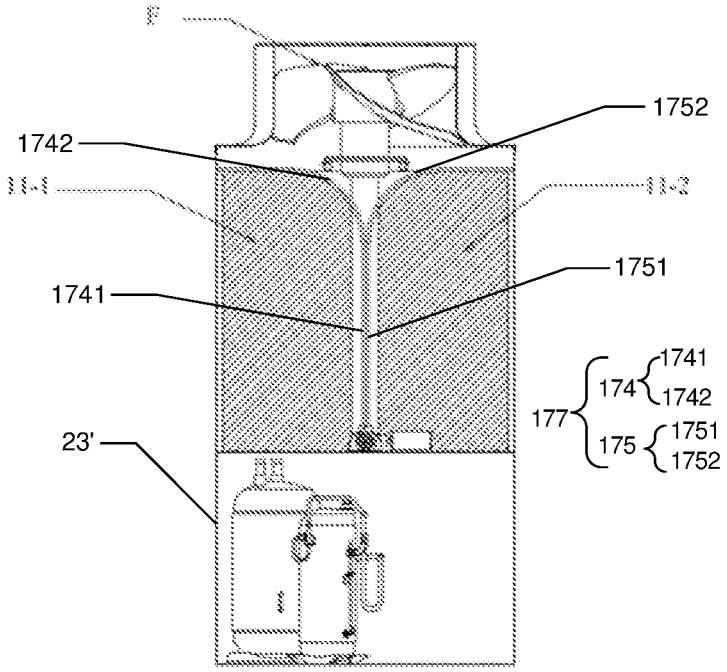
FIG. 6 is a section view of an outdoor unit, in accordance with some embodiments.

For example, as shown in FIG. 6, the outdoor heat exchangers included in a same outdoor unit A or A' share a same outdoor fan. In this case, there is one outdoor fan F included in the outdoor unit A. The outdoor fan F is controlled by the controller 30 and is configured to send flowing air to the outdoor heat exchangers 11-1 and 11-2, so that the flowing air exchanges heat through the outdoor heat exchangers 11-1 and 11-2. In this way, the outdoor unit A or A' has a compact structure, which is convenient for installation and is conducive to reducing a floor area of the outdoor unit A or A' and reducing noise created by the outdoor unit A or A'.

Figure 7:
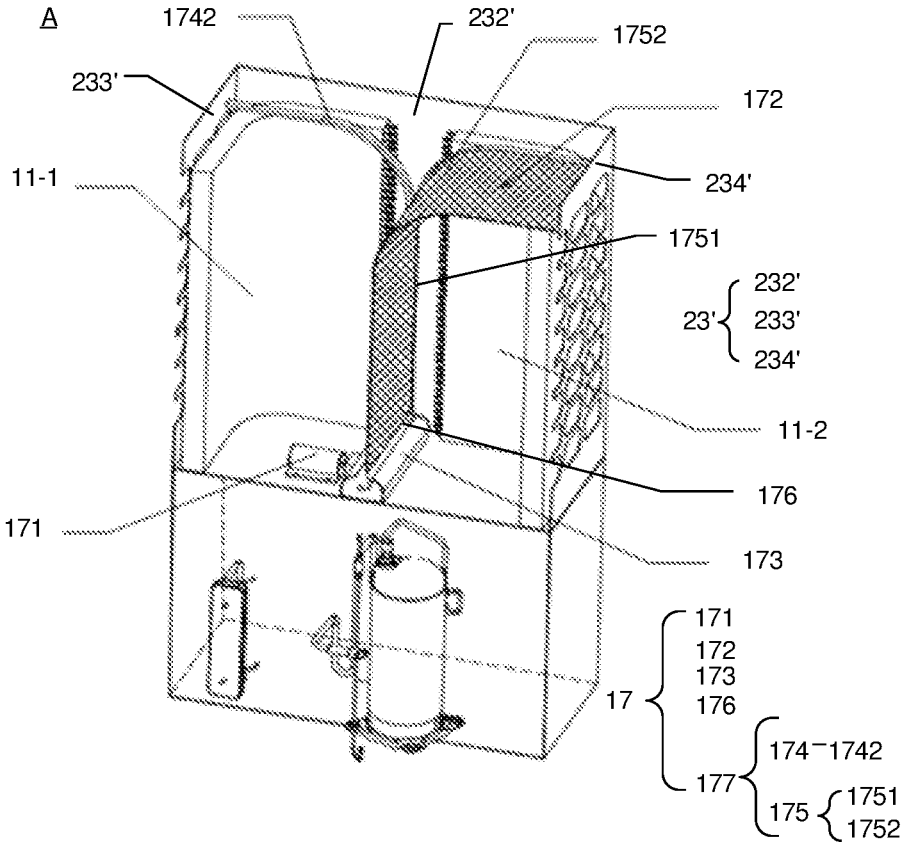
FIG. 7 is a diagram showing a structure of yet another outdoor unit, in accordance with some embodiments.
Figure 8:
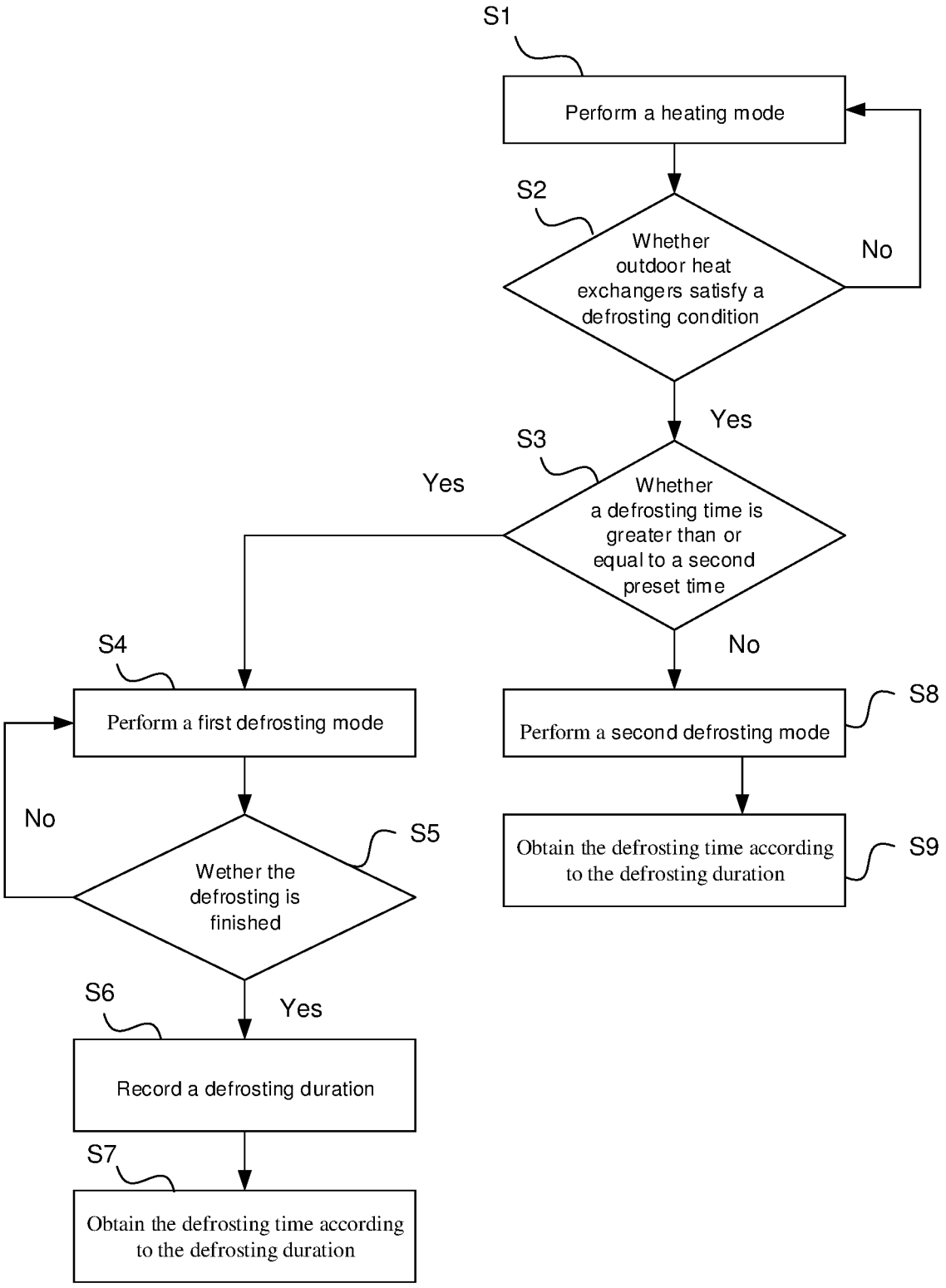
FIG. 8 is a flow diagram showing a defrosting process of an air conditioner, in accordance with some embodiments.

In some embodiments, as shown in FIG. 7, the outdoor unit A further includes a second separating device 17. A part of the second separating device 17 is used as a wind screen between the outdoor heat exchanger 11-1 or 11-2 and the outdoor fan F in the outdoor unit A. The second separating device 17 is controlled by the controller 30.

That is, in the outdoor unit A, when one of the two outdoor heat exchangers (e.g., the outdoor heat exchanger 11-1) is defrosted, the controller 30 controls the second separating device 17 to move to separate the outdoor heat exchanger 11-1 from the outdoor fan F, so that the outdoor heat exchanger 11-1 is located in a wind isolation region and the outdoor heat exchanger 11-2 and the outdoor fan F are located in a wind supply region. That is, the outdoor heat exchanger 11-1 is located on a side of the second separating device 17, and the outdoor heat exchanger 11-2 and the outdoor fan F are located on another side of the second separating device 17. Therefore, it may be possible to prevent the outdoor heat exchanger 11-1 from being affected by the wind generated by the outdoor fan F during defrosting.

The process of defrosting the outdoor heat exchanger 11-2 is the same as the process of defrosting the outdoor heat exchanger 11-1, and details will not be repeated here.

The frost formation process of the air conditioner 1000 is described below.

In the case where the air conditioner 1000 operates in the cooling mode, the outdoor heat exchangers 11-1 and 11-2 dissipate heat, and the indoor heat exchangers 5-1 to 5-4 absorb heat; when an air circulation amount is insufficient, moisture around the indoor heat exchangers 5-1 to 5-4 is rapidly condensed into frost.

In the case where the air conditioner 1000 operates in the heating mode, the outdoor heat exchangers 11-1 and 11-2 absorb heat, and the indoor heat exchangers 5-1 to 5-4 dissipate heat; when the outdoor environment temperature is low, the outdoor heat exchangers 11-1 and 11-2 need to absorb heat, and moisture around the outdoor heat exchangers 11-1 and 11-2 is rapidly condensed into frost.

As the frosting amount increases, the surfaces of the outdoor heat exchangers 11-1 and 11-2 are covered by frost, so that the surface heat transfer coefficients of the outdoor heat exchangers 11-1 and 11-2 are reduced, and the gas flow resistance is increased, which affects the heating effect of the air conditioner.

In light of this, for example, referring to FIG. 3, the outdoor unit A further includes defrost branches 15-1' and 15-2'. A first end of the defrost branch 15-1' is communicated to an air exhaust port of the compressor 1, and a second end of the defrost branch 15-1' is communicated to a liquid pipe of the outdoor heat exchanger 11-1. A first end of the defrost branch 15-2' is communicated to the air exhaust port of the compressor 1, and a second end of the defrost branch 15-2' is communicated to a liquid pipe of the outdoor heat exchanger 11-2.

The defrost branch 15-1' (or 15-2') is used for dividing a refrigerant discharged from the compressor 1 and making the divided refrigerant flow into a corresponding outdoor heat exchanger 11-1 (or 11-2). A portion of refrigerant, obtained after the refrigerant discharged from the compressor 1 is divided, does not simultaneously flow into the outdoor heat exchangers 11-1 and 11-2; that is, the portion of the refrigerant flows into one of the outdoor heat exchangers 11-1 and 11-2.

For example, as shown in FIG. 3, the outdoor unit A further includes third throttling devices 15-1 and 15-2. The third throttling devices 15-1 and 15-2 are also controlled by the controller 30. The third throttling device 15-1 is connected in the defrost branch 15-1', and is configured to throttle the portion of the refrigerant discharged from the compressor 1, and after a pressure of the throttled portion of the refrigerant is a preset pressure, transmit the throttled portion of the refrigerant to the outdoor heat exchanger 11-1 for defrosting. The third throttling device 15-2 is connected in the defrost branch 15-2', and is configured to throttle another portion of the refrigerant discharged from the compressor 1, and after a pressure of the another portion of the refrigerant is the preset pressure, transmit the another portion of the refrigerant to the outdoor heat exchanger 11-2 for defrosting.

In the case where the air conditioner 1000 operates in the heating mode, in order to defrost the outdoor heat exchanger 11-1 or 11-2 and prevent a refrigerant that flows through the indoor heat exchangers 5-1 to 5-4 from flowing in the outdoor heat exchanger 11-1 or 11-2 after heat exchange, the controller 30 controls the first throttling devices 22-1 and 22-2 to be turned off. Therefore, the refrigerant flowing through the indoor heat exchangers 5-1 to 5-4 is blocked. The second end of the defrost branch 15-1' is connected to a pipeline between the first throttling device 22-1 and a liquid-phase refrigerant inflow port of the outdoor heat exchanger 11-1, and the second end of the defrost branch 15-2' is connected to a pipeline between the second throttling device 22-2 and a liquid-phase refrigerant inflow port of the outdoor heat exchanger 11-2.

As shown in FIG. 3, the structure of the outdoor unit A' is similar to the structure of the outdoor unit A, and details will not be repeated here.

In some embodiments, in the outdoor unit A, the outdoor heat exchanger 11-1 and the outdoor fan 12-1 corresponding to the outdoor heat exchanger 11-1 develop a first wind field; the outdoor heat exchanger 11-2 and the outdoor fan 12-2 corresponding to the outdoor heat exchanger 11-2 develop a second wind field.

The first separating device 16 is configured to separate the first wind field and the second wind field, so as to make the first wind field and the second wind field be independent from each other. That is, the first wind field and the second wind field do not interfere mutually.

Of course, in a case where the outdoor unit includes three, four, or more outdoor heat exchangers, the first separating device 16 is configured to separate two adjacent wind fields.

Figure 4:
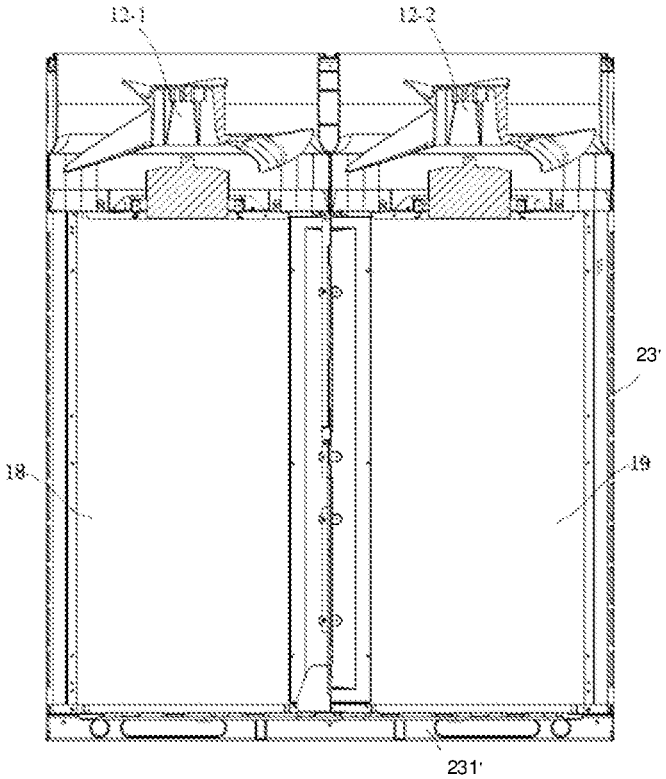
FIG. 4 is a sectional view of an outdoor unit, in accordance with some embodiments.

In some embodiments, as shown in FIGS. 3, 4, and 6, the outdoor unit A further includes a housing 23'. In this way, the first wind field and the second wind field independent from each other may be easily established through the housing 23'.

For example, as shown in FIG. 7, the housing 23' includes a top cover plate, a front panel, a back panel 232', a left side panel 233', a right side panel 234', and a bottom plate 231'. The top cover plate, the front panel, the back panel 232', the left side panel 233', the right side panel 234' and the bottom plate 231' enclose an inner space of the housing 23'.

The first separating device 16 is located in the inner space of the housing 23', and is configured to divide the inner space of the housing 23' into two independent air ducts. For example, as shown in FIG. 4, the two independent air ducts are a first air duct 18 and a second air duct 19. The first fan 12-1 and the outdoor heat exchanger 11-1 are located in the first air duct 18, and the second fan 12-2 and the outdoor heat exchanger 11-2 are located in the second air duct 19.

The outdoor heat exchanger 11-1, the first air duct 18 and the first fan 12-1 constitute a first air duct system, and the outdoor heat exchanger 11-2, the second air duct 19 and the second fan 12-2 constitute a second air duct system. The first air duct system and the second air duct system may independently operate.

Since the first air duct system and the second air duct system are separated by the first separating device 16, the two wind fields of the two air duct systems are not interfered during the operation. In the case where the air conditioner 1000 operates in the heating mode, the two air duct systems operate simultaneously. In a case where the outdoor heat exchangers 11-1 and 11-2 are alternately defrosted, the first air duct system and the second air duct system alternately operate.

In a case where the outdoor heat exchanger 11-1 in the air conditioner 1000 is defrosted, an operation state of the second air duct system remains at an operation state of the second air duct system when the air conditioner 1000 operates in the heating mode. In a case where the outdoor heat exchanger 11-2 in the air conditioner 1000 is defrosted, an operation state of the first air duct system remains at an operation state of the first air duct system when the air conditioner 1000 operates in the heating mode. Thus, the air conditioner 1000 may continuously and uninterruptedly heat, and it is conducive to improving the heating effect of the air conditioner 1000.

Figure 5:
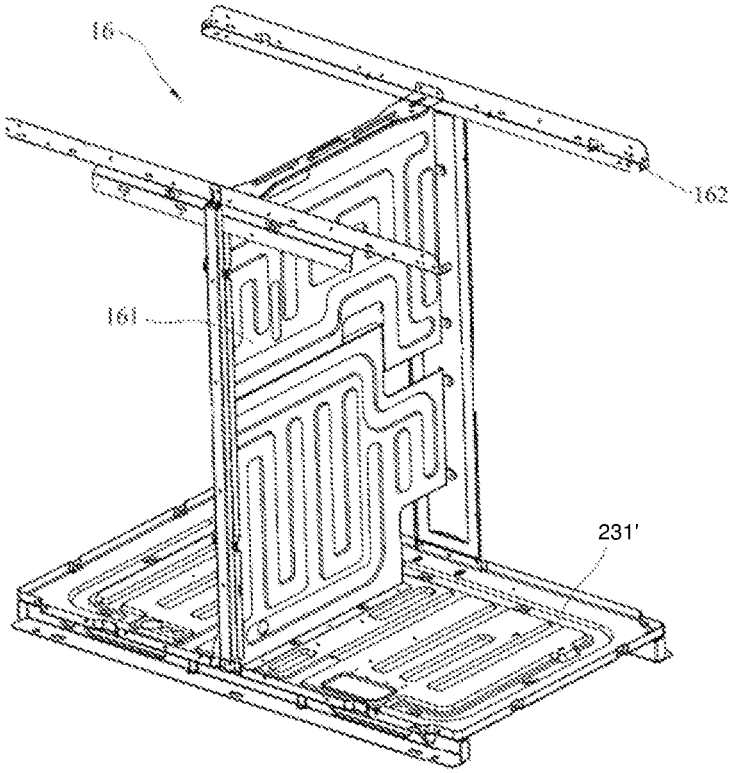
FIG. 5 is a perspective view of a first separating device of an outdoor unit, in accordance with some embodiments.

In some embodiments, as shown in FIG. 5, the first separating device 16 includes a separating plate 161, and the separating plate 161 is installed perpendicular to the bottom plate 231' and separates the inner space of the housing 23' into two independent air ducts.

In some embodiments, as shown in FIG. 5, the first separating device 16 further includes a connecting assembly 162, and the connecting assembly 162 is disposed on a side of the separating device 161 away from the bottom plate 231'. For example, the connecting assembly 162 is disposed on a side of the separating plate 161 away from the bottom plate 231', and the connecting assembly 162 is perpendicular to a plane where the separating plate 161 is located, and is parallel to a plane where the bottom plate 231' is located. The separating plate 161 is connected to the housing 23' through the connecting assembly 162, and the connection manner between the housing 23' and the connecting assembly 162 may be a screw connection manner or a screw and snap connection manner.

In some embodiments, referring to FIGS. 2, 5 and 6, two outdoor heat exchangers share a same outdoor fan F, the second separating device 17 is disposed in the housing 23', and the outdoor fan F is disposed on the second separating device 17. The second separating device 17 includes a driving assembly 171, a guideway 177, and a wind blocking portion 172. The wind blocking portion 172 is retractable and extendable. The wind blocking portion 172 is slidably connected to the guideway 177. The driving assembly 171 is coupled to the controller 30. The driving assembly 171 is controlled by the controller 30. The driving assembly 171 is connected to the wind blocking portion 172, and drives the wind blocking portion 172 to move along the guideway 177. In this way, the wind blocking portion 172 may be used as a wind screen between the outdoor fan F and one of the outdoor heat exchangers 11-1 and 11-2.

When the wind blocking portion 172 is unfolded, the inner space of the housing is divided into a wind supply region and a wind isolation region. The outdoor fan F and the outdoor heat exchanger that operates as an evaporator are located in the air supply region. The to-be-defrosted outdoor heat exchanger is located in the wind isolation region. The wind blocking portion 172 separates the outdoor fan from the to-be-defrosted outdoor heat exchanger and prevents the wind generated by the outdoor fan from blowing to the to-be-defrosted outdoor heat exchanger.

In some embodiments, as shown in FIG. 7, the second separating device 17 further includes an accommodation portion 173. the accommodation portion 173 is located between the outdoor heat exchangers 11-1 and 11-2, and the accommodation portion 173 is connected to a side of the wind blocking portion 172, so as to accommodate the wind blocking portion 172. Another side of the wind blocking portion 172 opposite to the side of the wind blocking portion 172 may move, along the guideway 177, from the accommodation portion 173 toward the outdoor fan F or from the outdoor fan F toward the accommodation portion 173.

In some embodiments, as shown in FIG. 7, the guideway 177 includes a first guide rail 174 and a second guide rail 175. For example, as shown in FIG. 6, the first guide rail 174 includes a first straight portion 1741 and a first curved portion 1742. The first straight portion 1741 is located between the outdoor heat exchangers 11-1 and 11-2, and is disposed on a side wall of the housing 23' (e.g., a side wall of the back panel 232'). A length direction of the first straight portion is substantially perpendicular to the bottom plate 231'. An end of the first straight portion 1741 proximate to the bottom plate 231' is connected to a side of an opening of the accommodation portion 173. The opening of the accommodation portion 173 is used to allow the wind blocking portion 172 to extend outward from an inside of the accommodation portion 173. After the wind blocking portion 172 extends outward from the inside of the accommodation portion 173, the first straight portion 1741 guides the wind blocking portion 172 to move toward the outdoor fan F, so as to separate the outdoor heat exchangers 11-1 and 11-2.

The first curved portion 1742 extends from an end of the first straight portion 1741 away from the bottom plate 231' to a side wall adjacent to the side wall of the housing 23' (e.g., a side wall of the left side panel 233'). That is, a first end of the first curved portion 1742 is connected to the end of the first straight portion 1741 away from the bottom plate 231', and a second end of the first curved segment 1742 is connected to the side wall of the left side panel 233'. The end of the first straight portion 1741 away from the bottom plate 231' is proximate to a top of the outdoor heat exchanger 11-1 (i.e., a side of the outdoor heat exchanger 11-1 proximate to the outdoor fan F), and the first curved portion 1742 extends to the side wall of the left side panel 233' bypassing the top of the outdoor heat exchanger 11-1. After the wind blocking portion 172 moves to a position where the first straight portion 1741 and the first curved portion 1742 are connected, the first curved portion 1742 guides the wind blocking portion 172 to move towards the side wall of the left side panel 233'. In this way, in a case where the wind blocking portion 172 moves along the first guide rail 174 from the accommodation portion 173 to the top of the outdoor heat exchanger 11-1, the wind blocking portion 172 may cause the outdoor heat exchanger 11-1 to be enclosed in an independent space, thereby separating the outdoor heat exchanger 11-1 from the outdoor fan.

For example, as shown in FIG. 7, the second guide rail 175 includes a second straight portion 1751 and a second curved portion 1752. The second guide rail 175 is disposed on the side wall of the back panel 232', and the second curved portion 1752 extends toward a side wall of the right side panel 234'. The arrangement manner of the second guide rail 175 is similar to that of the first guide rail 174, and details will not be repeated here.

Since the first guide rail 174 and the second guide rail 175 guide the wind blocking portion 172 to move, the wind blocking portion 172 may be controlled to move along a preset trajectory.

In some embodiments, as shown in FIG. 7, the second separating device 17 further includes a reversing assembly 176. The reversing assembly 176 is disposed between the accommodation portion 173 and the guideway 177. The reversing assembly 176 is controlled by the controller 30, and is configured to guide the wind blocking portion 172 to the first rail 174 or the second rail 175. Through the reversing assembly 176, a selected one of the first rail 174 and the second rail 175 may guide the wind blocking portion 172 to move, so that the wind blocking portion 172 is unfolded. In some embodiments, the reversing assembly 176 is an electromagnetically attracted reversing assembly or a mechanically reversing assembly.

The operation modes of the air conditioner 1000 include a heating mode, a cooling mode, a first defrosting mode, and a second defrosting mode.

In a case where the air conditioner 1000 operates in the heating mode, the outdoor heat exchanger operates as an evaporator, so that the decompressed refrigerant evaporates by absorbing heat from the outdoor air through the outdoor heat exchanger. The indoor heat exchanger operates as a condenser, so that the refrigerant, which has absorbed heat through the outdoor heat exchanger, condensates by dissipating heat into the indoor air through the indoor heat exchanger.

In a case where the air conditioner 1000 operates in the cooling mode, the outdoor heat exchanger operates as a condenser, so that the refrigerant compressed by the compressor condensates by dissipating heat into the outdoor air through the outdoor heat exchanger. The indoor heat exchanger operates as an evaporator, so that the refrigerant, which has dissipated heat through the outdoor heat exchanger, evaporates by absorbing heat from the indoor air through the indoor heat exchanger.

In a case where the air conditioner 1000 operates in the first defrosting mode, the indoor fan and the outdoor fan stop operating, the outdoor heat exchanger operates as a condenser, and the indoor heat exchanger operates as an evaporator, so that all the outdoor heat exchangers are defrosted.

In a case where the air conditioner 1000 operates in the second defrosting mode, an outdoor fan corresponding to a to-be-defrosted outdoor heat exchanger (i.e., an outdoor heat exchanger in the air conditioner 1000) stops operating, the to-be-defrosted outdoor heat exchanger operates as a condenser, the another outdoor heat exchangers operate as evaporators, and the indoor heat exchangers operate as condensers, so that the to-be-defrosted outdoor heat exchanger is defrosted.

The operation mode of the air conditioner 1000 is described below by taking the heating mode as an example.

In some embodiments, the operation mode of the air conditioner 1000 is the heating mode and, referring to FIG. 3, the second throttling devices 13-1 and 13-2 in the outdoor unit A are each in a turned-on state, the third throttling devices 15-1 and 15-2 are each in a turned-off state, the first throttling devices 22-1 and 22-2 are each in a turned-on state, and the outdoor fans 12-1 and 12-2 are each in a turned-on state.

In some embodiments, as shown in FIG. 3, the outdoor unit A further includes a first shut-off valve 3. The first shut-off valve 3 is connected to a pipe between the four-way valve 2 and the indoor unit 10 (which is referred to as an air pipe). The air conditioner 1000 further includes a first extension pipe 4, a first end of the first shut-off valve 3 is communicated to the terminal E of the four-way valve 2, and a second end of the first shut-off valve 3 is communicated to a first end of the first extension pipe 4. A second end of the first extension pipe 4 is communicated to gas-phase refrigerant inlet ports of the indoor heat exchangers 5-1 to 5-4.

In some embodiments, as shown in FIG. 3, the indoor unit 10 further includes fourth throttling devices 7-1 to 7-4, the air conditioner 1000 further includes a second extension pipe 8, and the outdoor unit A further includes a second shut-off valve 9 and a gas-liquid separator 14. The second shut-off valve 9 is connected to a pipe between the first throttling device 22-1 or 22-2 and the indoor unit 10 (which is referred to as a liquid pipe). First ends of the fourth throttling devices 7-1 to 7-4 are communicated to liquid-phase refrigerant outflow ports of the indoor heat exchangers 5-1 to 5-4, respectively. Second ends of the fourth throttling devices 7-1 to 7-4 are communicated to a first end of the second extension pipe 8, a second end of the second extension pipe 8 is communicated to a first end of the second shut-off valve 9, and a second end of the second shut-off valve 9 is communicated to the first throttling devices 22-1 and 22-2. A first end of the gas-liquid separator 14 is communicated to the terminal S of the four-way valve 2, and a second end of the gas-liquid separator 14 is communicated to the compressor 1.

In a case where the outdoor heat exchangers 11-1 and 11-2 in the outdoor unit A share a same outdoor fan F, the outdoor fan F is in a turned-on state.

The heating cycle of the air conditioner 1000 is as follows. The controller 30 controls the four-way valve 2 to switch the flowing directions of the refrigerant after the four-way valve 2 is powered on, so that the terminals D and E are communicated, and the terminals C and S are communicated (as shown in FIG. 3). The compressor 1 compresses a low-temperature and low-pressure refrigerant into a high-temperature and high-pressure refrigerant. The high-temperature and high-pressure refrigerant passes through the terminals D and E, then enters the indoor heat exchangers 5-1 to 5-4 through the first shut-off valve 3 and the first extension pipe 4. The high-temperature and high-pressure refrigerant is condensed and releases heat to become a liquid refrigerant after undergoing heat exchange in the indoor heat exchangers 5-1 to 5-4. The liquid refrigerant enters the first throttling devices 22-1 and 22-2 through the fourth throttling devices 7-1 to 7-4, the second extension pipe 8, and the second shut-off valve 9, so as to be throttled to a low-temperature and low-pressure gas-liquid two-phase refrigerant. The low-temperature and low-pressure gas-liquid two-phase refrigerant enters the outdoor heat exchangers 11-1 and 11-2, and the low-temperature and low-pressure gas-liquid two-phase refrigerant absorbs heat and is evaporated to become a gas-phase refrigerant. The gas-phase refrigerant discharged from the outdoor heat exchangers 11-1 and 11-2 is throttled by the second throttling devices 13-1 and 13-2. The throttled gas-phase refrigerant enters the gas-liquid separator 14 through the terminals C and S, and is sucked and compressed by the compressor 1. In this way, the heating cycle is completed.

The flowing direction of the refrigerant in the heating mode is shown by the solid arrows in FIG. 3.

The operation mode of the air conditioner 1000 is described below by taking the cooling mode as an example.

In some embodiments, the operation mode of the air conditioner 1000 is the cooling mode and, referring to FIG. 3, the second throttling devices 13-1 and 13-2 in the outdoor unit A are each in a turned-on state, the third throttling devices 15-1 and 15-2 are each in a turned-off state, the first throttling devices 22-1 and 22-2 are each in a turned-on state, and the outdoor fans 12-1 and 12-2 are each in a turned-on state.

In some embodiments, the outdoor heat exchangers 11-1 and 11-2 in the outdoor unit A share a same outdoor fan F, and the outdoor fan F is in a turned-on state.

The cooling cycle of the air conditioner 1000 is as follows. The four-way valve 2 is powered off, so that the terminals D and C are communicated, and the terminals E and S are communicated. The compressor 1 compresses a low-temperature and low-pressure refrigerant into a high-temperature and high-pressure refrigerant. The high-temperature and high-pressure refrigerant passes through the terminals D and C, and then enters the outdoor heat exchangers 11-1 and 11-2 after being throttled by the second throttling devices 13-1 and 13-2. The throttled high-temperature and high-pressure refrigerant is condensed and releases heat to become a liquid refrigerant after undergoing heat exchange in the outdoor heat exchangers 11-1 and 11-2. The liquid refrigerant passes through the first throttling devices 22-1 and 22-2, the second shut-off valve 9, and the second extension pipe 8, and enters the indoor heat exchangers 5-1 to 5-4 to absorb heat and be evaporated. In this way, the liquid refrigerant transforms into a gas-phase refrigerant. The gas-phase refrigerant discharged from the indoor heat exchangers 5-1 to 5-4 enters the gas-liquid separator 14 through the first extension pipe 4, the first shut-off valve 3, and the terminals E and S of the four-way valve, and is sucked and compressed by the compressor 1. In this way, the cooling cycle is completed.

The operation mode of the air conditioner 1000 is described below by taking the first defrosting mode as an example.

In a case where the controller 30 determines that the outdoor heat exchangers 11-1 and/or 11-2 need to be defrosted, the controller 30 controls the compressor 1 to reduce an operation frequency of the compressor 1 or stop operating, and the indoor fans 6-1 to 6-4 and the outdoor fans 12-1 and 12-2 stop operating (or in a case where the outdoor unit A includes a single outdoor fan F, the outdoor fan F stops operating).

Then, the four-way valve 2 is powered off, so that the terminals D and C are communicated, and the terminals E and S are communicated. The compressor 1 increases its operation frequency or starts operating, the outdoor heat exchangers 11-1 and 11-2 operate as condensers, and the indoor heat exchangers 5-1 to 5-4 operate as evaporators, so as to defrost the outdoor heat exchangers 11-1 and 11-2.

After the outdoor heat exchangers 11-1 and 11-2 are defrosted, the compressor 1 is turned off; then, the four-way valve switches the flowing directions of the refrigerant after being powered on, the compressor 1 restarts operating, the outdoor fans 12-1 and 12-2 restart operating (or in a case where the outdoor unit A includes a single outdoor fan F, the outdoor fan F restarts operating), the indoor fans 6-1 to 6-4 operate according to a cold wind prevention program, and the operation mode of the air conditioner 1000 is the heating mode. The first defrosting mode has a good defrosting effect, and it is conducive to prolonging the service life of the air conditioner 1000.

The cold wind prevention program may include: detecting, by a detection device of the air conditioner 1000, temperatures of the indoor heat exchangers 5-1 to 5-4, and controlling, by the controller 30, the operation states of the indoor fans 6-1 to 6-4 according to the temperatures of the outdoor heat exchangers 5-1 to 5-4. For example, when the detection device detects that the temperatures of the indoor heat exchangers 5-1 to 5-4 reach a first temperature (e.g., 20° C.), the controller 30 may control the indoor fans 6-1 to 6-4 to start operating at a low rotation speed, and control each of the rotation speeds of the indoor fans 6-1 to 6-4 to be increased according to one of the temperatures of the indoor heat exchangers 5-1 to 5-4. In a case where the temperatures of the indoor heat exchangers 5-1 to 5-4 reach a second temperature (e.g., 38° C.), the controller 30 controls the rotation speeds of the indoor fans 6-1 to 6-4 according to a wind speed set by the user.

The operation mode of the air conditioner 1000 is described below by taking the second defrosting mode as an example.

In a case where a plurality of outdoor heat exchangers in the outdoor unit A need to be defrosted, the operation mode of the air conditioner 1000 is the second defrosting mode. In this way, the plurality of outdoor heat exchangers are defrosted alternately rather than simultaneously.

Figure 9:
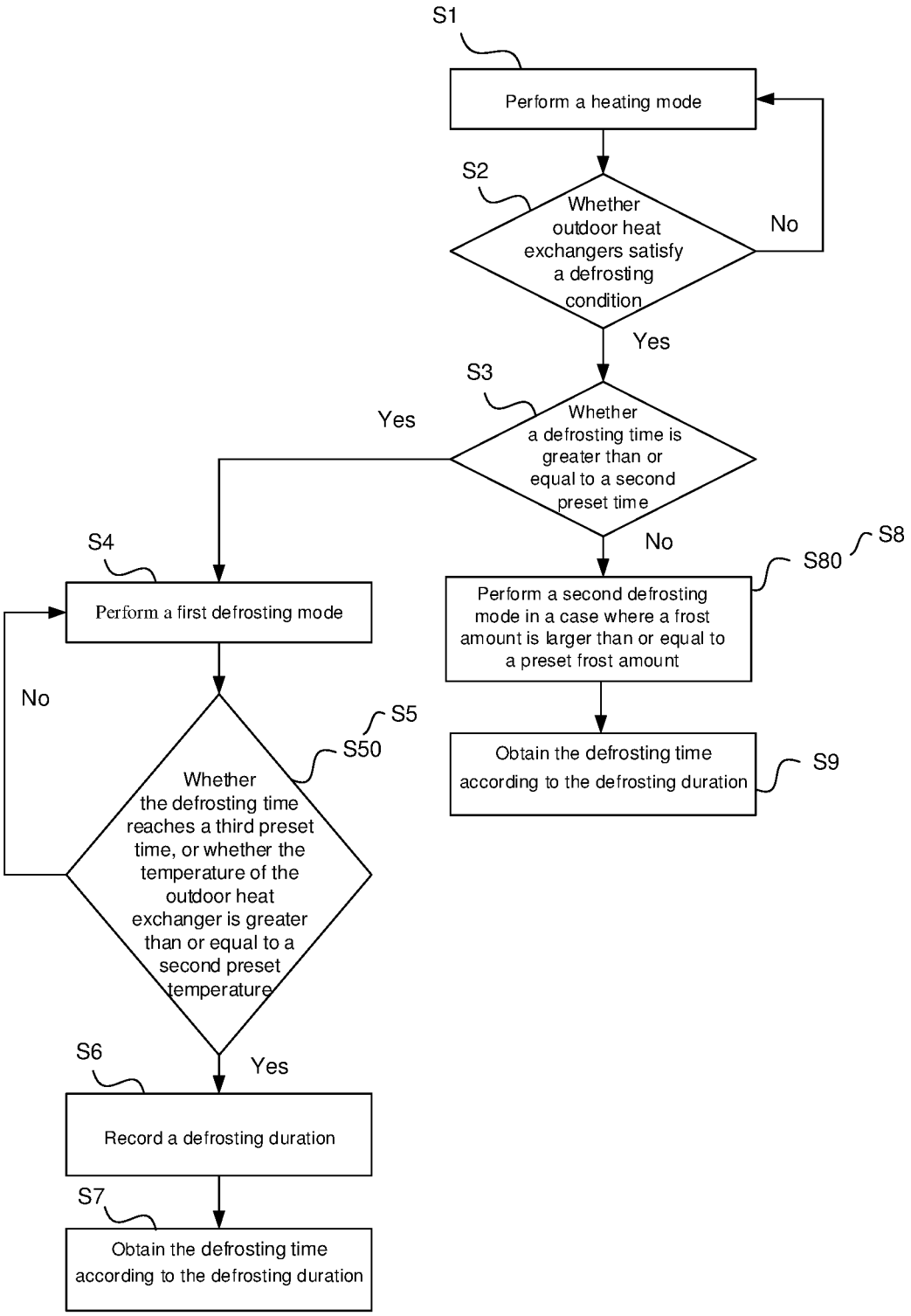
FIG. 9 is a flow diagram showing yet another defrosting process of an air conditioner, in accordance with some embodiments.

In some embodiments, referring to FIGS. 2, 7, and 9, the operating process of the air conditioner 1000 is described by taking an example where the outdoor heat exchangers 11-1 and 11-2 in the outdoor unit A need to be defrosted.

In step S1, the air conditioner 1000 operates in the heating mode.

In step S2, the controller 30 determines whether the outdoor heat exchangers 11-1 and 11-2 satisfy a defrosting condition; if the controller 30 determines that the outdoor heat exchangers 11-1 and 11-2 satisfy the defrosting condition, step S3 is performed, and if the controller 30 determines that the outdoor heat exchangers 11-1 and 11-2 do not satisfy the defrosting condition, the process returns to step S1.

Whether the defrosting condition is satisfied may be determined according to an operation time of the compressor 1 being greater than or equal to a preset operation time, and a temperature difference between a environment temperature of the outdoor unit A and a temperature of the outdoor heat exchanger being greater than or equal to a preset temperature difference. Here, the temperature of the outdoor heat exchanger may be a temperature of an outdoor unit coil.

In step S3, the controller 30 determines whether the defrosting time T is greater than or equal to a second preset time T1; if the controller 30 determines that the defrosting time T is greater than or equal to the second preset time T1, step S4 is performed; and if the controller 30 determines that the defrosting time T is not greater than or equal to the second preset time T1, step S8 is performed.

By determining the relationship between the defrosting time T and the second preset time T1, a next operation mode of the air conditioner 1000 being the first defrosting mode or the second defrosting mode is determined.

Figure 12:
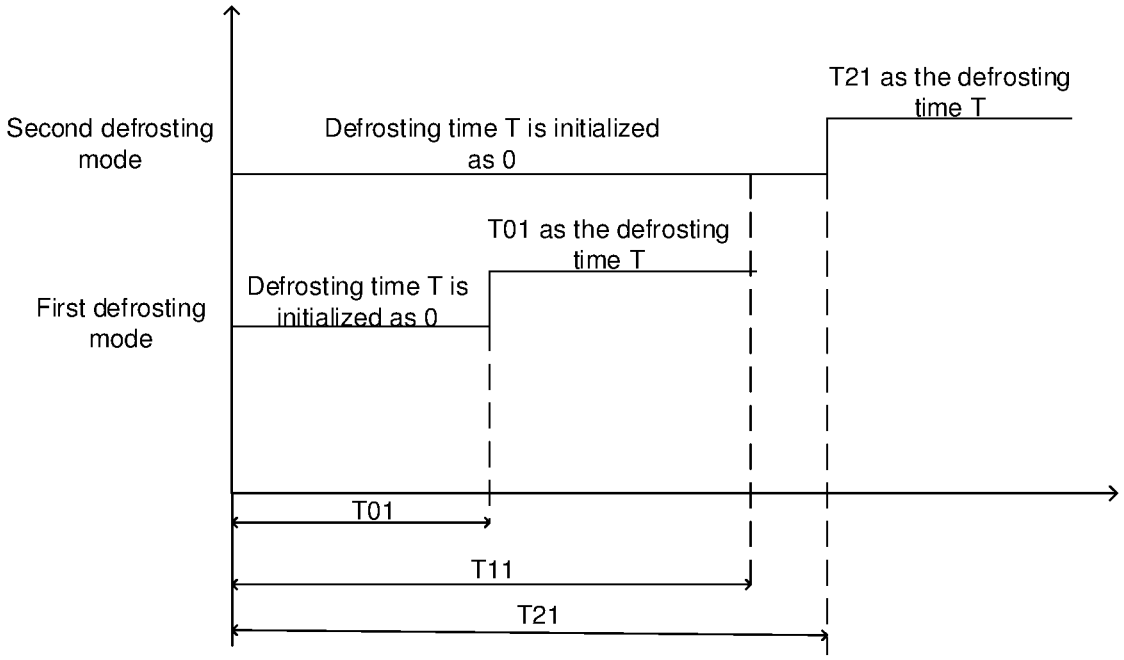
FIG. 12 is a diagram showing change of defrosting times of an air conditioner operating in a first defrosting mode and a second defrosting mode, in accordance with some embodiments.

As shown in FIG. 12, the defrosting time T is initialized to zero when the air conditioner 1000 operates for the first time after installation. Thereafter, in each defrosting process of the to-be-defrosted outdoor heat exchanger in the air conditioner 1000 (i.e., in a process in which the first defrosting mode or the second defrosting mode is performed each time), the defrosting time T is updated after the defrosting is finished.

When the air conditioner 1000 operates in the first defrosting mode, the outdoor heat exchangers 11-1 and 11-2 in the outdoor unit A simultaneously perform defrosting. A first time T01, from a moment at which the defrosting of the outdoor heat exchangers 11-1 and 11-2 starts to a moment at which the defrosting of the outdoor heat exchangers 11-1 and 11-2 ends, is the defrosting time T.

When the air conditioner 1000 operates in the second defrosting mode, the outdoor heat exchangers 11-1 and 11-2 in the outdoor unit A are alternately defrosted. A second time, from a moment at which the defrosting of the outdoor heat exchanger 11-1 starts to a moment at which the defrosting of the outdoor heat exchanger 11-1 ends, is T11. A third time, from a moment at which the defrosting of the outdoor heat exchanger 11-2 starts to a moment at which the defrosting of the outdoor heat exchanger 11-2 ends, is T21. A larger value of T11 and T21 is selected as the defrosting time T.

In step S4, the air conditioner 1000 operates in the first defrosting mode.

In step S5, the controller 30 determines whether the defrosting is finished; if the controller 30 determines that the defrosting is finished, step S6 is performed; if the controller 30 determines that the defrosting is not finished, the process returns to step S4.

In some embodiments, as shown in FIG. 9, step S5 includes step S50.

In step S50, the controller 30 determines whether the defrosting time T reaches a third preset time T2, or whether the temperature D0 of the outdoor heat exchanger is greater than or equal to a second preset temperature D1.

In step S6, a defrosting duration T' is recorded.

In a case where the air conditioner 1000 includes a single outdoor unit (e.g., the outdoor unit A), the defrosting duration T' is recorded as a first value T11'.

In a case where the air conditioner 1000 includes two outdoor units (e.g., the outdoor units A and A'), the defrosting time T' has two values, which are recorded as a first value T11' and a second value T21'.

It will be noted that, the defrosting duration T' may be a duration from a moment at which the four-way valve 2 is switched to start defrosting to a moment at which the four-way valve 2 is switched again to stop defrosting.

In step S7, the defrosting time T is obtained according to the defrosting duration T'.

In a case where the air conditioner 1000 includes a single outdoor unit, the defrosting time T is equal to the defrosting duration T11' (i.e., T=T11').

In a case where the air conditioner 1000 includes two outdoor units, the defrosting time T is a larger value of the first value T11' and the second value T21'.

In step S8, the air conditioner 1000 operates in the second defrosting mode.

In some embodiments, as shown in FIG. 9, step S8 includes step S80.

In step S80, in a case where a frosting amount of the to-be-defrosted outdoor heat exchanger 11-1 and a frosting amount of the to-be-defrosted outdoor heat exchanger 11-2 are greater than or equal to a preset frosting amount, the outdoor heat exchangers 11-1 and 11-2 are defrosted alternately.

For example, the outdoor heat exchangers 11-1 and 11-2 are sequentially defrosted according to an order of the frosting amount of the outdoor heat exchanger 11-1 and the frosting amount of the outdoor heat exchanger 11-2 from a larger one to a smaller one.

The frosting amount may be determined by detecting an index representing a frosting amount through a detection device. The index representing the frosting amount may be at least one of heating capacities of the outdoor heat exchangers 11-1 and 11-2, an evaporation temperature of the refrigerant, a wind outlet temperature of the indoor unit 10, and a liquid pipe temperature of the outdoor heat exchanger.

The controller 30 predicts the frosting amount of the outdoor heat exchanger 11-1 and the frosting amount of the outdoor heat exchanger 11-2 according to a change of detected data. For example, the detection device detects liquid pipe temperatures of the outdoor heat exchangers 11-1 and 11-2, and the controller 30 receives liquid pipe temperature data from the detection device, so as to determine the frosting amount of the outdoor heat exchanger 11-1 and the frosting amount of the outdoor heat exchanger 11-2. The smaller the liquid pipe temperature is, the larger the frosting amount of the outdoor heat exchanger is.

If the frosting amount of the outdoor heat exchanger 11-2 is larger than the frosting amount of the outdoor heat exchanger 11-1, the outdoor heat exchanger 11-2 is defrosted first, so as to prevent the excessive frosting of the outdoor heat exchanger 11-2 from affecting the normal operation of the outdoor heat exchanger 11-2. In this case, a state of the outdoor heat exchanger 11-1 is the same as a state of the outdoor heat exchanger 11-1 when the air conditioner 1000 operates in the heating mode. That is, the outdoor heat exchanger 11-2 operates as a condenser, and the outdoor heat exchanger 11-1 operates as an evaporator.

After the outdoor heat exchanger 11-2 is defrosted and the outdoor heat exchanger 11-2 is at a state of the outdoor heat exchanger 11-2 when the air conditioner 1000 operates in the heating mode, the outdoor heat exchanger 11-1 is defrosted. That is, the outdoor heat exchanger 11-1 operates as a condenser, and the outdoor heat exchanger 11-2 operates as an evaporator.

Figure 10:
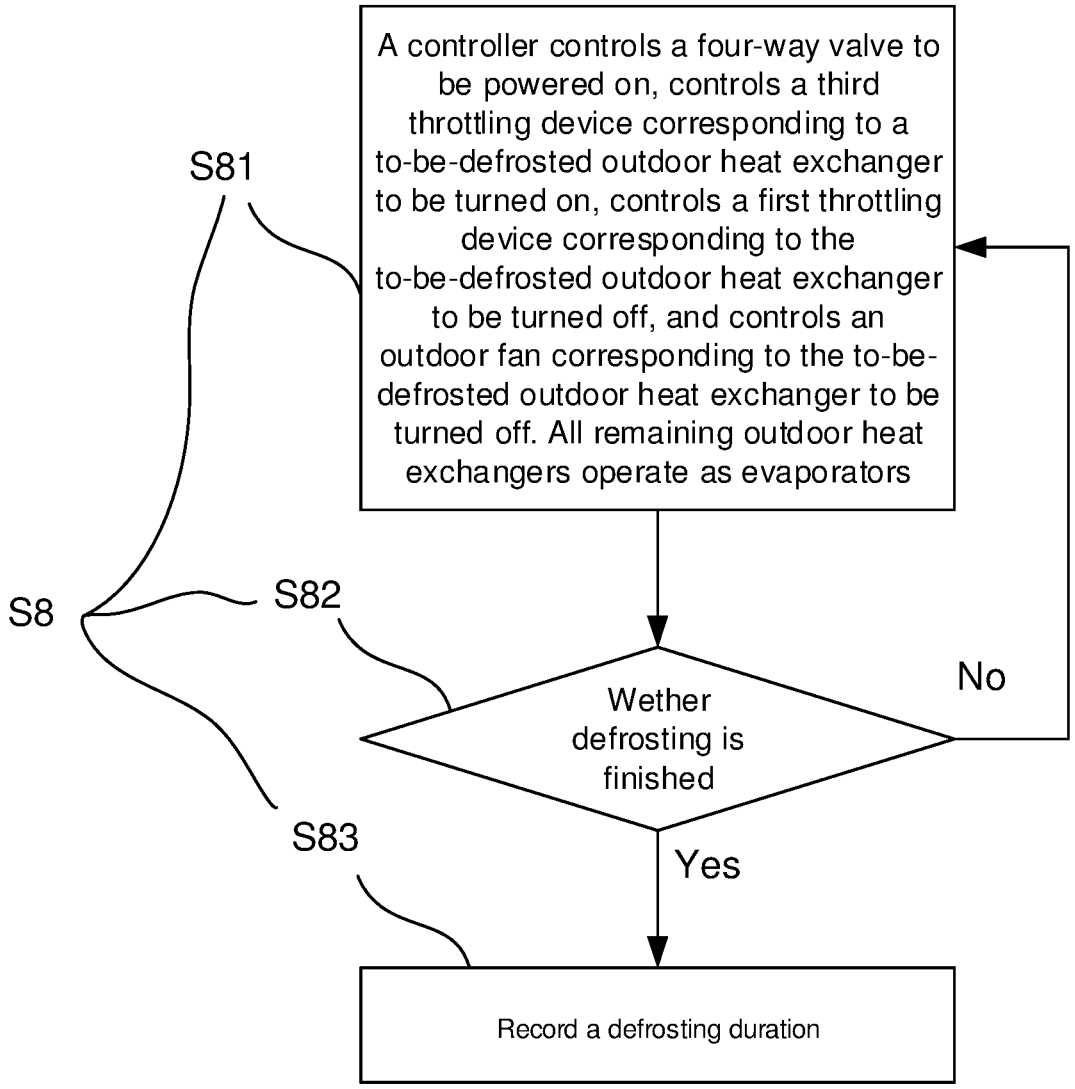
FIG. 10 is a flow diagram showing a defrosting process of an outdoor heat exchanger in a second defrosting mode, in accordance with some embodiments.

The defrosting process of the plurality of outdoor heat exchangers is shown in FIG. 10.

In a case where the number of the outdoor heat exchangers is the same as the number of the outdoor fans, step S8 includes steps S81 to S83.

In step S81, the controller 30 controls the four-way valve 2 to be powered on, controls the third throttling device 15-1 or 15-2 corresponding to the to-be-defrosted outdoor heat exchanger to be turned on, controls the first throttling device corresponding to the to-be-defrosted outdoor heat exchanger to be turned off, and controls the outdoor fan corresponding to the to-be-defrosted outdoor heat exchanger to be turned off. All remaining outdoor heat exchangers operate as evaporators.

The following description is illustrated by taking an example where the outdoor heat exchanger 11-2 is defrosted. The four-way valve 2 remains powered on, the controller 30 controls the third throttling device 15-2 in the defrost branch 15-2' to be turned on, controls the outdoor fan 12-2 to be turned off, and controls the first throttling device 22-2 to be turned off. An operation state of each remaining device in the air conditioner 1000 is the same as a state of the remaining device when the air conditioner 1000 operates in the heating mode.

For example, as shown in FIG. 3, solid arrows indicate the flowing direction of the refrigerant flowing out of the outdoor heat exchanger 11-1 when the operation state of the outdoor heat exchanger 11-1 is the same as a state of the outdoor heat exchanger 11-1 during the operation of the heating mode, and dotted arrows indicate the flowing direction of the refrigerant flowing out of the outdoor heat exchanger 11-2 when the operation state of the outdoor heat exchanger 11-2 is the same as a state of the outdoor heat exchanger 11-2 during the operation of the second defrosting mode.

When the air conditioner 1000 operates in the second defrosting mode, the compressor 1 compresses a low-temperature and low-pressure refrigerant into a high-temperature and high-pressure refrigerant, and discharges the high-temperature and high-pressure refrigerant. A portion of the high-temperature and high-pressure refrigerant discharged from the compressor 1 passes through the terminals D and E of the four-way valve 2, the first shut-off valve 3, and the first extension pipe 4, and enters the indoor heat exchangers 5-1 to 5-4. The portion of the high-temperature and high-pressure refrigerant is condensed and releases heat to become a liquid refrigerant after undergoing heat exchange in the indoor heat exchangers 5-1 to 5-4. The liquid refrigerant passes through the fourth throttling devices 7-1 to 7-4, the second extension pipe 8, and the second shut-off valve 9, and then enters the first throttling device 22-1 to be throttled to a low-temperature and low-pressure gas-liquid two-phase refrigerant. The low-temperature and low-pressure gas-liquid two-state refrigerant enters the outdoor heat exchanger 11-1 to absorb heat and be evaporated, so as to become a gas-phase refrigerant. The gas-phase refrigerant discharged from the outdoor heat exchanger 11-1 is throttled by the second throttling device 13-1, and the throttled gas-phase refrigerant enters the gas-liquid separator 14 through the terminals C and S of the four-way valve 2, and is sucked and compressed by the compressor 1.

The process of defrosting the outdoor heat exchanger 11-2 is as follows. Another portion of the high-temperature and high-pressure refrigerant discharged by the compressor 1 is throttled by the third throttling device 15-2 in the defrost branch 15-2', and a pressure of the another portion of the high-temperature and high-pressure refrigerant after being throttled is a preset pressure (e.g., in a range of 0.8 MPa to 1.0 MPa, inclusive). Then, the another portion of the high-temperature and high-pressure refrigerant after being throttled enters the outdoor heat exchanger 11-2 to release heat, so as to defrost the outdoor heat exchanger 11-2. The refrigerant discharged from the outdoor heat exchanger 11-2 passes through the second throttling device 13-2. The refrigerant from the outdoor heat exchanger 11-2 and the refrigerant from the outdoor heat exchanger 11-1 join together, enter the gas-liquid separator 14 through the terminals C and S of the four-way valve, and are finally sucked and compressed by the compressor 1.

In a case where the outdoor heat exchanger 11-2 is defrosted, the outdoor fan 12-2 is turned off and the outdoor fan 12-1 is still turned on to dissipate heat. The first separating device 16 separates the second wind field where the outdoor heat exchanger 11-2 is located from the first wind field where the outdoor heat exchanger 12-1 is located. Therefore, even if the outdoor fan 12-1 still operates, the second wind field where the outdoor heat exchanger 11-2 is located is not affected.

In this way, it may be possible to effectively avoid a situation that wind blows through the surface of the outdoor heat exchanger 11-2 when the outdoor heat exchanger 11-2 is defrosted, and avoid a failure of effective defrosting due to excessive condensation load when the outdoor temperature is low; and the air conditioner 1000 may continuously heat.

In addition, in a period in which the outdoor fan 12-2 stops operating (i.e., in a period in which the outdoor heat exchanger 11-2 is defrosted), the rotation speed of the outdoor fan 12-1 may be appropriately increased. Therefore, the heating effect is improved, the fluctuation of the indoor temperature is reduced, and the heating capability of the air conditioner 1000 is improved.

In step S82, the controller 30 determines whether the defrosting is finished; if the controller 30 determines that the defrosting is finished, the defrosting is finished, and if the controller 30 determines that the defrosting is not finished, the process returns to step S81.

Step S82 includes: determining, by the controller 30, whether the defrosting duration T' reaches a first preset time T3, or determining, by the controller 30, whether an air pipe temperature Tg of the outdoor heat exchanger 11-2 is greater than or equal to a first preset temperature Tm and a suction pressure Ps of the compressor 1 is greater than or equal to a preset pressure Po; if the controller 30 determines that the defrosting duration T' reaches the first preset time T3, or the controller 30 determines that the air pipe temperature Tg of the outdoor heat exchanger 11-2 is greater than or equal to the first preset temperature Tm and the suction pressure Ps of the compressor 1 is greater than or equal to the preset pressure Po, the defrosting is determined to be finished; and if the controller 30 determines that the defrosting duration T' does not reach the first preset time T3, or the controller 30 determines that the air pipe temperature Tg of the outdoor heat exchanger 11-2 is not greater than or equal to the first preset temperature Tm and the suction pressure Ps of the compressor 1 is not greater than or equal to the preset pressure Po, the process returns to step S81.

Of course, whether the defrosting is finished may be determined by determining a supercooling degree of a refrigerant of an outflow side of the outdoor heat exchanger 11-2.

It will be noted that, the defrosting duration T' may be a duration in which the refrigerant discharged from the compressor 1 flows in the outdoor heat exchanger 11-2.

In step S83, the defrost duration T' is recorded.

In a case where the air conditioner 1000 includes a single outdoor unit, the single outdoor unit includes two outdoor heat exchangers, and the defrosting duration T' has two values, which are respectively recorded as T11' and T21'.

In a case where the air conditioner 1000 includes two outdoor units, each outdoor unit includes two outdoor heat exchangers, and the defrosting duration T' has four values, which are respectively recorded as T11', T21', T31' and T41'.

After the defrosting the outdoor heat exchanger 11-2 is finished, the air conditioner 1000 records a defrosting duration T1', and thereafter, the outdoor heat exchanger 11-2 is switched to operate in a same state as the state of the outdoor heat exchanger 11-2 when the air conditioner 1000 operates in the heating mode.

The process of switching the outdoor heat exchanger 11-2 from a defrosting state to the same state as the state of the outdoor heat exchanger 11-2 when the air conditioner 1000 operates in the heating mode, includes:

controlling, by the controller 30, the third throttling device 15-2 in the defrost branch 15-2' to be turned off;

controlling, by the controller 30, the outdoor fan 12-2 to be turned on; and controlling, by the controller 30, the first throttling device 22-2 to be turned on.

In this way, the outdoor fan 12-2 and the first throttling device 22-2 are turned on, the third throttling device 15-2 is turned off, and the second throttling device 13-2 is turned on to be at a preset opening degree, which may avoid overheating of an outflow port of the outdoor heat exchanger 11-2.

Subsequently, the outdoor heat exchanger 11-1 is defrosted; in this case, the outdoor heat exchanger 11-2 operates as an evaporator, and the operation state of the outdoor heat exchanger 11-2 is the same as a state of the outdoor heat exchanger 11-2 when the air conditioner 1000 operates in the heating mode.

The four-way valve 2 remains powered on, the controller 30 controls the third throttling device 15-1 in the defrost branch 15-1' to be turned on, controls the outdoor fan 12-1 to be turned off, and controls the first throttling device 22-1 to be turned off. An operation state of each remaining device in the air conditioner 1000 is the same as a state of the remaining device when the air conditioner 1000 operates in the heating mode.

As for the defrosting process of the outdoor heat exchanger 11-1, reference can be made to the defrosting process of the outdoor heat exchanger 11-2, and details will not be repeated here.

When the outdoor heat exchanger 11-1 is defrosted, the operation state of the outdoor heat exchanger 11-2 is the same as the state of the outdoor heat exchanger 11-2 when the air conditioner 1000 operates in the heating mode.

In a case where the outdoor heat exchanger 11-1 in the air conditioner 1000 is defrosted, the controller 30 controls the outdoor fan 12-1 and the first throttling device 22-1 to be turned off, and controls the third throttling device 15-1 and the second throttling device 13-1 to be turned on to be at a preset opening degree, so as to control the pressure in the outdoor heat exchanger 11-1 and the flow rate of the refrigerant flowing in the outdoor heat exchanger 11-1.

For example, the second throttling devices 13-1 and 13-2, and the third throttling devices 15-1 and 15-2 are electronic expansion valves or two-way thermostatic expansion valves.

After the defrosting the outdoor heat exchanger 11-1 is finished, a defrosting time T2' is recorded.

Figure 11:
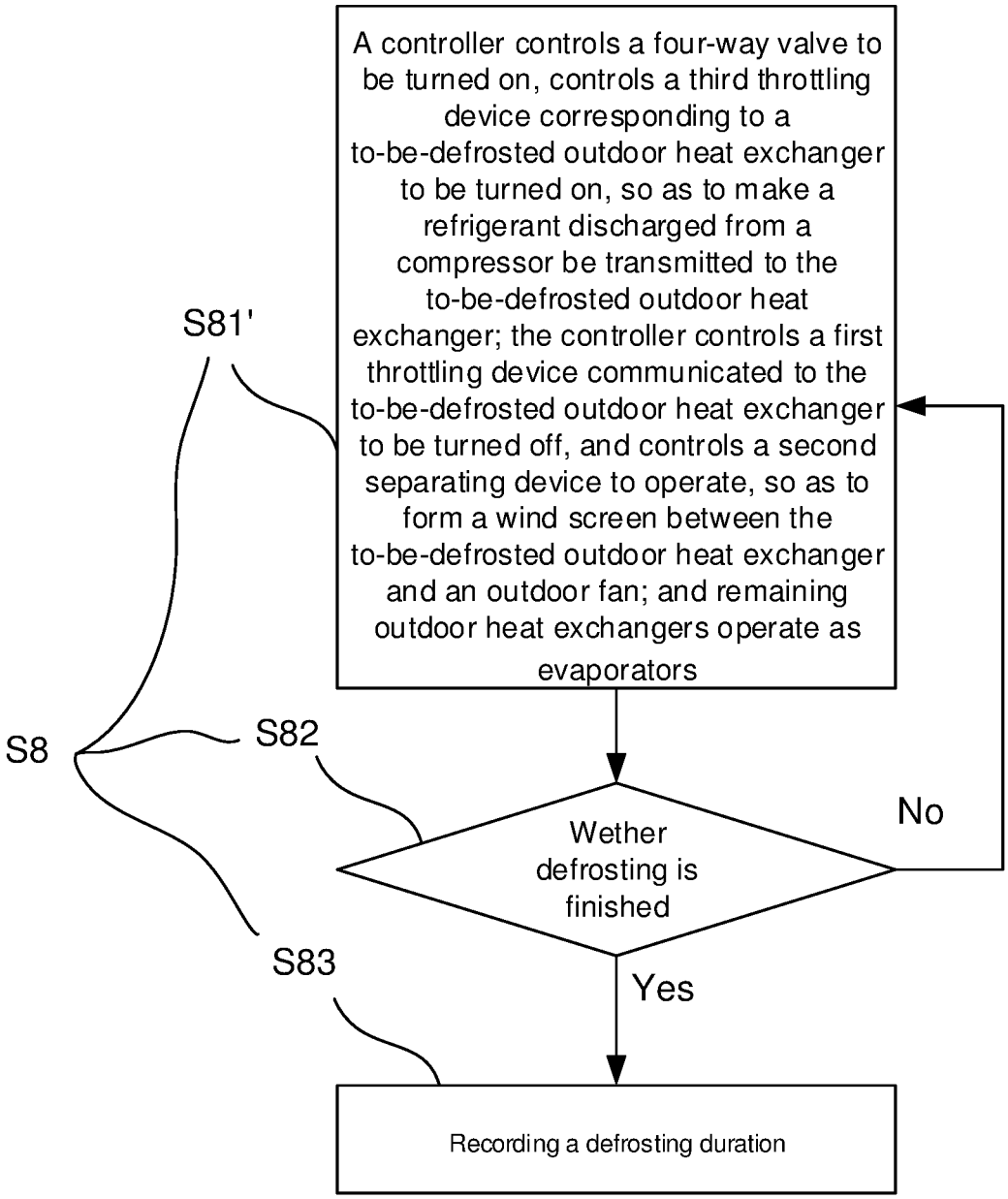
FIG. 11 is a flow diagram showing yet another defrosting process of an outdoor heat exchanger in a second defrosting mode, in accordance with some embodiments.

Compared with a case where the outdoor unit A includes two outdoor fans, in a case where the outdoor heat exchangers 11-1 and 11-2 in the outdoor unit A share a single outdoor fan F, the single outdoor fan F is turned on all the time, and the controller 30 further controls the second separating device 17. For example, as shown in FIG. 11, step S8 further includes step S81'.

In step S81', the controller 30 controls the four-way valve 2 to be turned on, controls the third throttling device corresponding to the to-be-defrosted outdoor heat exchanger to be turned on, so as to make the refrigerant discharged from the compressor 1 be transmitted to the to-be-defrosted outdoor heat exchanger; the controller 30 controls the first throttling device communicated to the to-be-defrosted outdoor heat exchanger to be turned off, and controls the second separating device 17 to operate, so that the second separating device 17 is used as a wind screen between the to-be-defrosted outdoor heat exchanger and the outdoor fan F; and the remaining outdoor heat exchangers operate as evaporators.

In step S9, the defrosting time T is obtained according to the defrosting duration T'.

For example, the outdoor heat exchanger 11-2 in the outdoor unit A is the to-be-defrosted outdoor heat exchanger. In the process of defrosting the outdoor heat exchanger 11-2, the outdoor heat exchanger 11-1 operates as an evaporator, and the operation state of the outdoor heat exchanger 11-1 is the same as a state of the outdoor heat exchanger 11-1 when the air conditioner 1000 operates in the heating mode.

The process of defrosting the outdoor heat exchanger 11-2 is as follows. The four-way valve 2 remains powered on. The controller 30 controls the third throttling device 15-2 in the defrost branch 15-2' to be turned on, controls the outdoor fan F to be turned on, and controls the second separating device 17 to operate, so that the second separating device 17 is used as a wind screen between the outdoor heat exchanger 11-2 and the outdoor fan F; in this case, the outdoor fan F supplies wind to the outdoor heat exchanger 11-1. The controller 30 controls the first throttling device 222 to be turned off. An operation state of each remaining device in the air conditioner 1000 is the same as a state of the remaining device when the air conditioner 1000 operates in the heating mode.

The defrosting process of the to-be-defrosted outdoor heat exchanger is the same as the defrosting process described above, and details will not be repeated here.

When the outdoor heat exchanger 11-2 in the air conditioner 1000 is defrosted, the outdoor fan F is turned on all the time, so as to keep the heat dissipation of the outdoor heat exchanger 11-1. The second separating device 17 separates the wind field generated by the outdoor fan F from the outdoor heat exchanger 11-2, so that the outdoor heat exchanger 11-2 is not affected even if the outdoor fan F still operates.

Switching a state of the outdoor heat exchanger 11-2 when the outdoor heat exchanger 11-2 is defrosted to a state of the outdoor heat exchanger 11-2 when the air conditioner 1000 operates in the heating mode, includes:

controlling, by the controller 30, the third throttling device 15-2 in the defrost branch 15-2' to be turned off;

controlling, by the controller 30, the second separating device 17 to operate, so as to make the outdoor fan F supply wind to the outdoor heat exchanger 11-2, and make the outdoor fan F be separated from the outdoor heat exchanger 11-1; and controlling, by the controller 30, the first throttling device 22-2 to be turned on.

Subsequently, when the outdoor heat exchanger 11-1 in the air conditioner 1000 is defrosted, the outdoor heat exchanger 11-2 operates as an evaporator, and the operation state of the outdoor heat exchanger 11-2 is same as the state of the outdoor heat exchanger 11-2 when the air conditioner 1000 operates in the heating mode.

For example, referring to FIG. 3, the air conditioner 1000 includes more than one outdoor unit (e.g., the outdoor units A and A').

In a case where all outdoor heat exchangers in the outdoor units A and A' (i.e., the outdoor heat exchangers 11-1 and 11-2 in the outdoor unit A and the outdoor heat exchangers 11-1' and 11-2' in the outdoor unit A') are defrosted, the outdoor heat exchangers are defrosted sequentially according to their frosting amount. In each defrosting process, one outdoor heat exchanger is taken as a to-be-defrosted outdoor heat exchanger, and the remaining three outdoor heat exchangers operate as evaporators. In this case, the influence of the defrosting mode on fluctuation of the indoor temperature is reduced.

In addition, it may achieve a good heating effect and achieve a continuous heating of the air conditioner 1000.

For example, the air conditioner 1000 may include three, four, or more outdoor units.

It will be understood by those skilled in the art that the scope of the disclosure of the present invention is not limited to the above embodiments, and certain elements of the embodiments can be modified and replaced without departing from the spirit of the present application. The scope of the present application is limited by the following claims.

What is claimed is:

1. An air conditioner, comprising:

an indoor unit;

an outdoor unit connected to the indoor unit, the outdoor unit including:

a housing;

a compressor disposed in the housing;

a four-way valve connected to the compressor and configured to switch flowing directions of a refrigerant;

a plurality of outdoor heat exchangers arranged in parallel and connected to the compressor and the four-way valve;

an outdoor fan disposed on a side of the plurality of outdoor heat exchangers and configured to suck outdoor air into the housing and to discharge the outdoor air that has undergone heat exchange through the plurality of outdoor heat exchangers out of the housing; and a separating device disposed between the plurality of outdoor heat exchangers, including:

a wind blocking portion; and a driving assembly connected to the wind blocking portion and configured to drive the wind blocking portion to move, so as to separate a first outdoor heat exchanger of the plurality of outdoor heat exchangers from the outdoor fan; and a controller coupled to the compressor, the four-way valve, the outdoor fan, and the driving assembly, and configured to: control a first portion of a refrigerant flowing out from the compressor to flow into the first outdoor heat exchanger; control a second portion of the refrigerant flowing out from the compressor to flow into the indoor unit; and when a time in which the first portion of the refrigerant flows into the first outdoor heat exchanger is less than a first preset time, prevent a refrigerant flowing out from the indoor unit from flowing into the first outdoor heat exchanger, and control the driving assembly to drive the wind blocking portion to move, so as to separate the outdoor fan from the first outdoor heat exchanger.

2. The air conditioner according to claim 1, wherein the controller is further configured to:

when the time in which the first portion of the refrigerant flowing into the first outdoor heat exchanger is greater than or equal to the first preset time, control the first portion of the refrigerant to stop flowing into the first outdoor heat exchanger, control the second portion of the refrigerant flowing out from the compressor to flow into the indoor unit, control the refrigerant flowing out from the indoor unit to flow into the first outdoor heat exchanger, and control the driving assembly to drive the wind blocking portion to move so as to drive the outdoor fan to suck the outdoor air into the housing and discharge the outdoor air that has undergone heat exchange through the first outdoor heat exchanger out of the housing.

3. The air conditioner according to claim 2, wherein the controller is further configured to:

after the driving assembly drives the wind blocking portion to move so as to drive the outdoor fan to suck the outdoor air into the housing and the outdoor air that has undergone heat exchange through the first outdoor heat exchanger is discharged out of the housing, control a third portion of the refrigerant flowing out from the compressor to flow into a second outdoor heat exchanger of the plurality of outdoor heat exchangers, control a fourth portion of the refrigerant flowing out from the compressor to flow into the indoor unit, prevent the refrigerant flowing out from the indoor unit from flowing into the second outdoor heat exchanger, and control the driving assembly to drive the wind blocking portion to move so as to separate the outdoor fan from the second outdoor heat exchanger.

4. The air conditioner according to claim 3, wherein the controller is further configured to:

when a time in which the third portion of the refrigerant flowing into the second outdoor heat exchanger is greater than or equal to the first preset time, or when a temperature of the second outdoor heat exchanger is greater than or equal to a first preset temperature and a suction pressure of the compressor is greater than or equal to a preset pressure, control the third portion of the refrigerant to stop flowing into the second outdoor heat exchanger, control the fourth portion of the refrigerant to flow into the indoor unit, and control the driving assembly to drive the wind blocking portion to move so as to drive the outdoor fan to suck the outdoor air into the housing and discharge the outdoor air that has undergone heat exchange through the second outdoor heat exchanger out of the housing.

5. The air conditioner according to claim 4, wherein the controller is further configured to:

after the driving assembly drives the wind blocking portion to move so as to drive the outdoor fan to suck the outdoor air into the housing and the outdoor air that has undergone heat exchange through the second outdoor heat exchanger is discharged out of the housing, obtain a defrosting time according to the time in which the first portion of the refrigerant flows into the first outdoor heat exchanger and the time in which the third portion of the refrigerant flows into the second outdoor heat exchanger.

6. The air conditioner according to claim 5, wherein the defrosting time is a larger value of the time in which the first portion of the refrigerant flows into the first outdoor heat exchanger and the time in which the third portion of the refrigerant flows into the second outdoor heat exchanger.

7. The air conditioner according to claim 5, wherein the controller is further configured to:

when the first outdoor heat exchanger satisfies a defrosting condition and the defrosting time is less than the second preset time, control the first portion of the refrigerant to flow into the first outdoor heat exchanger, control the second portion of the refrigerant to flow into the indoor unit, prevent the refrigerant flowing out from the indoor unit from flowing into the first outdoor heat exchanger, and control the driving assembly to drive the wind blocking portion to move so as to separate the outdoor fan from the first outdoor heat exchanger.

8. The air conditioner according to claim 7, wherein the controller is further configured to:

when the first outdoor heat exchanger satisfies the defrosting condition and the defrosting time is greater than or equal to the second preset time, control the compressor to reduce an operation frequency of the compressor or stop operating, control the outdoor fan to stop operating, and control the four-way valve to switch the flowing directions of the refrigerant, and then control the compressor to increase the operation frequency or start operating.

9. The air conditioner according to claim 8, wherein the defrosting condition includes:

an operation time of the compressor is greater than or equal to a preset operation time, and a temperature difference between an environment temperature of the outdoor unit and a temperature of the first outdoor heat exchanger is greater than or equal to a preset temperature difference.

10. The air conditioner according to claim 1, wherein the controller is further configured to:

when a temperature of the outdoor heat exchanger is greater than or equal to a first preset temperature and a suction pressure of the compressor is greater than or equal to a preset pressure, control the first portion of the refrigerant to stop flowing into the first outdoor heat exchanger, control the second portion of the refrigerant to flow into the indoor unit, control the refrigerant flowing out from the indoor unit to flow into the first outdoor heat exchanger, control the driving assembly to drive the wind blocking portion to move so as to drive the outdoor fan to suck the outdoor air into the housing and discharge the outdoor air that has undergone heat exchange through the first outdoor heat exchanger out of the housing.

11. The air conditioner according to claim 1, wherein the controller is further configured to increase a rotation speed of the outdoor fan, so as to increase a heat exchange rate of the outdoor air through the first outdoor heat exchanger.

12. The air conditioner according to claim 1, wherein the controller is further configured to:

when a frosting amount of the first outdoor heat exchanger is greater than or equal to a preset frosting amount, control the first portion of the refrigerant flowing out from the compressor to flow into the first outdoor heat exchanger, control the second portion of the refrigerant flowing out from the compressor to flow into the indoor unit, prevent the refrigerant flowing out from the indoor unit from flowing into the outdoor heat exchanger, and control the driving assembly to drive the wind blocking portion to move so as to separate the outdoor fan from the first outdoor heat exchanger.

13. The air conditioner according to claim 1, wherein the controller is further configured to:

control the compressor to reduce an operation frequency of the compressor or stop operating, control the outdoor fan to stop operating, and control the four-way valve to switch the flowing directions of the refrigerant, and then control the compressor to increase the operation frequency or start operating.

14. The air conditioner according to claim 1, wherein the controller is further configured to:

when an operation time of the compressor is greater than or equal to a preset operation time and a temperature difference between an environment temperature of the outdoor unit and a temperature of the first outdoor heat exchanger is greater than or equal to a preset temperature difference, control the compressor to reduce an operation frequency of the compressor or stop operating, control the outdoor fan to stop operating, and control the four-way valve to switch the flowing directions of the refrigerant, and then control the compressor to increase the operation frequency or start operating.

15. The air conditioner according to claim 14, wherein the controller is further configured to:

when the operation frequency of the compressor is increased or when an operation time of the compressor after the compressor is started is greater than or equal to a third preset time, control the compressor to reduce the operation frequency or stop operating, and control the four-way valve to switch, and then control the compressor to increase the operation frequency or start operating, and control the outdoor fan to operate.

16. The air conditioner according to claim 15, wherein the controller is further configured to:

after the outdoor fan operates, obtain a defrosting time according to a time interval of the flowing directions of the refrigerant switched twice by the four-way valve.

17. The air conditioner according to claim 16, wherein the controller is further configured to:

when the first outdoor heat exchanger satisfies a defrosting condition and the defrosting time is less than a second preset time, control the first portion of the refrigerant flowing out from the compressor to flow into the first outdoor heat exchanger, control the second portion of the refrigerant flowing out from the compressor to flow into the indoor unit, prevent the refrigerant flowing out from the indoor unit from flowing into the first outdoor heat exchanger, and control the driving assembly to drive the wind blocking portion to move so as to separate the outdoor fan from the first outdoor heat exchanger.

18. The air conditioner according to claim 16, wherein the controller is further configured to:

when the first outdoor heat exchanger satisfies a defrosting condition and the defrosting time is greater than or equal to a second preset time, control the compressor to reduce the operation frequency or stop operating, control the outdoor fan to stop operating, and control the four-way valve to switch, and then control the compressor to increase the operation frequency or start operating.

19. The air conditioner according to claim 14, wherein the controller is further configured to:

when the temperature of the first outdoor heat exchanger is greater than or equal to a second preset temperature, control the compressor to reduce the operation frequency or stop operating, and control the four-way valve to switch, and then control the compressor to increase the operation frequency or start operating, and control the outdoor fan to operate.

20. The air conditioner according to claim 1, further comprising:

a plurality of first throttling devices arranged in liquid pipes of the plurality of outdoor heat exchangers; and a plurality of second throttling devices arranged in air pipes of the plurality of outdoor heat exchangers; wherein the controller is further configured to control on/off states of the plurality of first throttling devices and control on/off states of the plurality of second throttling devices.

* * * * *